US009257108B2

(12) United States Patent
Nakamura

(10) Patent No.: US 9,257,108 B2
(45) Date of Patent: Feb. 9, 2016

(54) MUSIC BOX FOR REDUCING MISALIGNMENT OF WHEELS

(71) Applicant: BROTHER KOGYO KABUSHIKI KAISHA, Nagoya, Aichi (JP)

(72) Inventor: Takuya Nakamura, Nagoya (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 14/315,540

(22) Filed: Jun. 26, 2014

(65) Prior Publication Data

US 2015/0000507 A1 Jan. 1, 2015

(30) Foreign Application Priority Data

Jun. 28, 2013 (JP) ..... 2013-137508

(51) Int. Cl.
*G10F 1/06* (2006.01)

(52) U.S. Cl.
CPC ..... *G10F 1/06* (2013.01)

(58) Field of Classification Search
CPC ..... G10H 1/32; G10F 1/06; G10F 5/06; G10F 5/04; A63H 29/22; A63H 17/395; A63H 11/00; A63H 2200/00; A63H 5/00; A63H 13/04; A63H 33/005; G07F 17/3269; G04R 20/10; G04B 23/00; G04B 23/005; G04B 27/04; G10K 1/067
See application file for complete search history.

(56) References Cited

U.S. PATENT DOCUMENTS

| | | | | | |
|---|---|---|---|---|---|
| 5,955,687 | A * | 9/1999 | Miyagi et al. | ..... | 84/97 |
| 5,962,796 | A * | 10/1999 | Nakamura et al. | ..... | 84/97 |
| 6,073,835 | A * | 6/2000 | Ramadan | ..... | 235/78 G |
| 2008/0184863 | A1 * | 8/2008 | White | ..... | 84/95.1 |
| 2014/0202303 | A1 * | 7/2014 | Ikeda | ..... | 84/98 |

FOREIGN PATENT DOCUMENTS

| | | | |
|---|---|---|---|
| JP | H09-97055 | A | 4/1997 |
| JP | 2002-073013 | A | 3/2002 |
| JP | 2005-17731 | A | 1/2005 |
| JP | 2011-128348 | A | 6/2011 |

OTHER PUBLICATIONS

Japanese Office Action dated Mar. 3, 2015 from related Japanese Application No. 2013-137508, together with an English language translation.

* cited by examiner

*Primary Examiner* — Marlon Fletcher
(74) *Attorney, Agent, or Firm* — Scully, Scott, Murphy & Presser, PC

(57) ABSTRACT

A music box includes a star wheel, a stopper, a sun wheel, a motor, a sensor, and a controller. The star wheel is configured to rotate about a first shaft. The sun wheel is fixed on a second shaft and engages the star wheel. The motor is configured to rotate the first shaft and the second shaft. The sensor is configured to detect a rotation state of the sun wheel. The controller is configured to: read a music data; control the motor to rotate at a rotational speed based on a temp; determine a start timing at which the stopper starts to release the star wheel based on a sound output timing and the rotation state; calibrate the start timing to a calibrated start timing based on a value related to the rotational speed; and control the stopper to release the star wheel at the calibrated start timing.

15 Claims, 10 Drawing Sheets

98

TARGET SPEED →

CURRENT SPEED ↓

| | 40 | 50 | 60 | 70 | 80 | 90 | 100 | 110 | 120 |
|---|---|---|---|---|---|---|---|---|---|
| 40 (35-44) | 16 | 16 | 12 | 12 | 10 | 8 | 8 | 7 | 7 |
| 50 (45-54) | ··· | 12 | ··· | ··· | ··· | ··· | ··· | ··· | ··· |
| 60 (55-64) | ··· | ··· | 10 | ··· | ··· | ··· | ··· | ··· | ··· |
| 70 (65-74) | ··· | ··· | ··· | 8 | ··· | ··· | ··· | ··· | ··· |
| 80 (75-84) | ··· | ··· | ··· | ··· | 7 | ··· | ··· | ··· | ··· |
| 90 (85-94) | ··· | ··· | ··· | ··· | ··· | 5 | ··· | ··· | ··· |
| 100 (95-104) | ··· | ··· | ··· | ··· | ··· | ··· | 4 | ··· | ··· |
| 110 (105-114) | ··· | ··· | ··· | ··· | ··· | ··· | ··· | 3 | ··· |
| 120 (115-124) | 4 | 4 | 3 | 3 | 2 | 2 | 2 | 2 | 2 |

MUSIC BOX FOR REDUCING MISALIGNMENT OF WHEELS

CROSS REFERENCE TO RELATED APPLICATION

This application claims priority from Japanese Patent Application No. 2013-137508 filed Jun. 28, 2013. The entire content of this priority application is incorporated herein by reference.

TECHNICAL FIELD

The present invention relates to a music box, and particularly to a music box that reduces imprecision in the meshingly engagement between wheels.

BACKGROUND

Music boxes for playing music are well known in the art. One such music box includes a plurality of vibration valves, star wheels provided with claws for plucking each of the vibration valves, and stoppers corresponding to the star wheels. The vibration valves correspond to different pitches and, when plucked by a claw on a star wheel, produce sound at the corresponding pitch. By providing this music box with a mechanism capable of selectively plucking the vibration valves, the music box can play any music. According to the technology of this music box, the star wheel rotates upon the disengagement of the corresponding stopper therefrom and is brought into engagement with a sun wheel. In this condition, the claws on the star wheels can be made to pluck desired vibration valves to produce arbitrary sounds. The rotational speed of the motor is changed based on the tempo of the music.

SUMMARY

However, in the conventional technology described above, a certain delay occurs after the stopper is brought into disengagement from the star wheel until the star wheel is actually disengaged and begins to rotate. The rotational amount of the sun wheel during the certain delay varies according to the tempo of the music. Thus, depending on the tempo of the music, the teeth on the sun wheel and the star wheel may become out of alignment, generating impact noise therebetween upon the engagement of the teeth on the respective wheels.

In view of the foregoing, it is an object of the present disclosure to provide a music box that suppresses imprecision in the meshingly engagement between wheels.

In order to attain the above and other objects, the present disclosure provides a music box. The music box may include a star wheel, a stopper, a sun wheel, a motor, a sensor, and a controller. The star wheel may be configured to rotate about a first shaft. The star wheel may include a claw. The stopper may be configured to halt a rotation state of the star wheel. The sun wheel may be fixed on a second shaft extending along the first shaft. The sun wheel may be configured to engage the star wheel which has been released from a halt by the stopper. The motor may be configured to rotate the first shaft and the second shaft. The sensor may be configured to detect a rotation state of the sun wheel. The controller may be configured to: read a music data specifying a sound output timing and a tempo from a storage unit; control the motor to rotate at a rotational speed based on the tempo of the music data; determine a start timing at which the stopper starts to release a halt of the rotation of the star wheel based on the sound output timing and the rotation state of the sun wheel detected by the sensor; calibrate the start timing to a calibrated start timing based on a value related to the rotational speed of the motor; and control the stopper to release the halt of the rotation of the star wheel at the calibrated start timing.

According to another aspect, the present disclosure provides a music box. The music box may include a star wheel, a stopper, an electromagnet, a sun wheel, a motor, a sensor, and a control unit. The star wheel is configured to rotate about a first shaft. The star wheel may include a claw. The stopper may be configured to halt a rotation of the star wheel. The electromagnet may be configured to attract the stopper to distance the claw away from the star wheel. The sun wheel may be fixed on a second shaft extending along the first shaft. The sun wheel may be configured to engage the star wheel which has been released from a halt by the stopper. The motor may be configured to rotate the first shaft and the second shaft. The sensor may be configured to detect a rotation state of the sun wheel. The control unit may be configured to: read a music data specifying a sound output timing and a tempo from a storage unit; control the motor to rotate at a rotational speed based on the tempo of the music data; determine a start timing at which the stopper starts to release a halt of the rotation of the star wheel based on the sound output timing and the rotation state of the sun wheel detected by the sensor; calibrate the start timing to a calibrated start timing based on a value related to the rotational speed of the motor; and energize the electromagnet at the calibrated start timing.

According to still another aspect, the present disclosure provides a music box. The music box may include a star wheel, a stopper, a sun wheel, a motor, a sensor, and a control unit. The star wheel may be configured to rotate about a first shaft. The star wheel may include a claw. The stopper may be configured to halt a rotation of the star wheel. The sun wheel may be fixed on a second shaft extending along the first shaft. The sun wheel may be configured to engage the star wheel which has been released from a halt by the stopper. The motor may be configured to rotate the first shaft and the second shaft. The sensor may be configured to detect a rotational amount of the sun wheel. The control unit may be configured to: read a music data specifying a sound output timing and a tempo from a storage unit; control the motor to rotate at a rotational speed based on the tempo of the music data; determine a start timing at which the stopper starts to release a halt of the rotation of the star wheel based on the sound output timing and the rotational amount of the sun wheel detected by the sensor; calibrate the start timing to a calibrated start timing based on a value related to the rotational speed of the motor; and control the stopper to release the halt of the rotation of the star wheel at the calibrated start timing.

BRIEF DESCRIPTION OF THE DRAWINGS

For a more complete understanding of the present disclosure, and the objects, features, and advantages thereof, reference now is made to the following descriptions taken in connection with the accompanying drawings.

DETAILED DESCRIPTION

Figure 1:
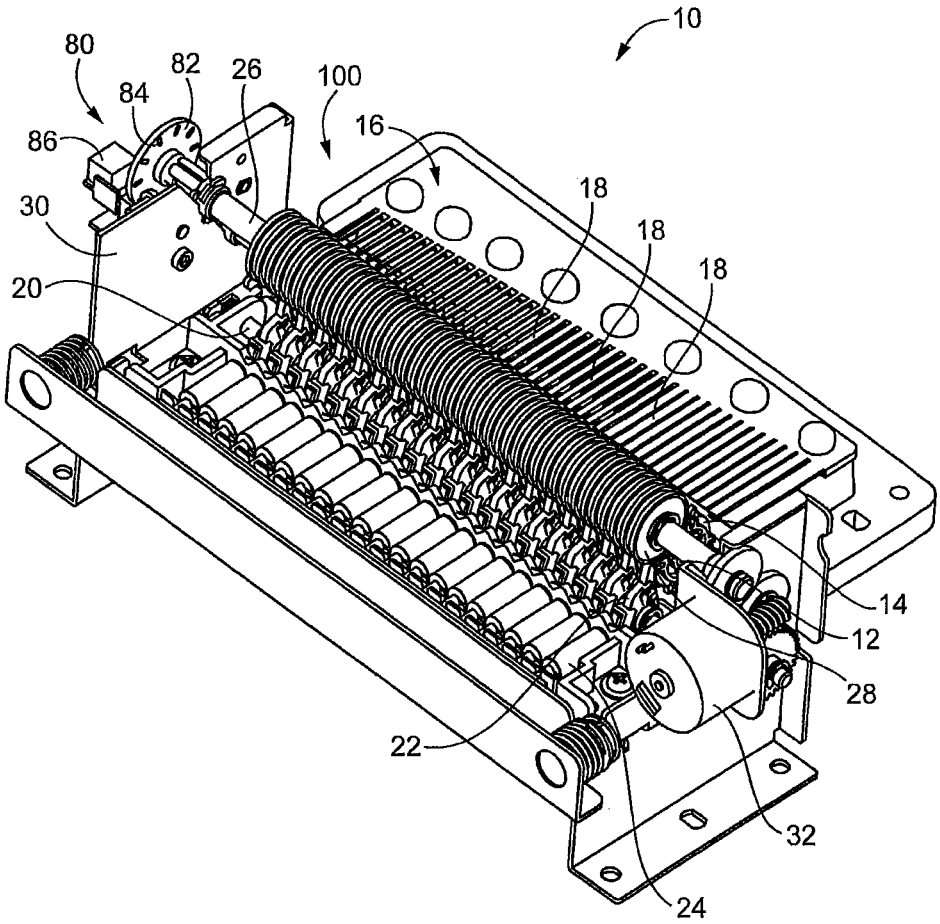
FIG. 1 is a schematic perspective view of a music box according to one or more aspects of the disclosure.

Next, a music box 10 according to a preferred embodiment of the present disclosure will be described while referring to the accompanying drawings. FIG. 1 shows the structure of a mechanical performance unit 100 provided in the music box 10 according to the preferred embodiment. In the preferred embodiment, the top of the music box 10 will be considered the uppermost portion of the music box 10 in a general vertical direction when the music box 10 is resting on a flat surface (not shown).

As shown in FIG. 1, the mechanical performance unit 100 includes a first shaft 12; a plurality (forty in this example) of star wheels 14 rotatably provided on the first shaft 12; a vibration plate 16 provided alongside the first shaft 12 and each having a plurality of vibration valves 18 juxtaposed alongside the first shaft 12 at positions corresponding to the star wheels 14; a second shaft 26 parallel to the first shaft 12; a pair of third shafts 20 arranged alongside the first shaft 12, and preferably parallel to the first shaft 12 and the second shaft 26; a plurality of stoppers 22 pivotally movable about each of the third shafts 20 and provided at positions corresponding to the each of the star wheels 14; a plurality of electromagnets 24 disposed in positions corresponding to the stoppers 22; a plurality of sun wheels 28 provided around the second shaft 26 at positions corresponding to the star wheels 14 so as to rotate together with and not relative to the second shaft 26; a frame 30 rotatably supporting the first shaft 12 and the second shaft 26 about their center axes, non-rotatably supporting the third shafts 20, and serving as a mounting base for the electromagnets 24, and the like; and a motor 32 adapted to produce a drive force for driving the first shaft 12 and the second shaft 26 to rotate about their axes in synchronization. Each sun wheel 28 is provided with a plurality of gear teeth 40 around the peripheral edge thereof. The vibration valves 18 correspond to discrete predetermined musical tones and produce a sound at the corresponding tone when plucked by a claw 36 (described later) on the corresponding star wheel 14. The mechanical performance unit 100 shown in FIG. 1 is mounted in an enclosure 34 of the music box 10 described below by assembling the frame 30 to the enclosure 34.

The torque from the output shaft of the motor 32 is preferably transferred to the first shaft 12 and the second shaft 26 through a well-known gear mechanism or the like. The first shaft 12 and the second shaft 26 should be driven to rotate at the same rotational speed (angular velocity). Specifically, the corresponding star wheel 14 and the sun wheel 28 are coupled through drive gears provided on their respective axial ends, with a suitable reduction ratio being employed so that the star wheel 14 and the sun wheel 28 rotate at the same speed when driven by output from the motor 32. Alternatively, individual motors may be provided for the first shaft 12 and the second shaft 26 and may be configured to drive the shafts to rotate at the same rotational speed.

The music box 10 is provided with a sensor for detecting the amount of displacement in the sun wheel 28, i.e., the amount of rotation of the sun wheel 28. The sensor should be provided adjacent to the sun wheel 28 and is configured of an encoder 80 for detecting the rotation state of the second shaft 26. The encoder 80 may detect an amount of displacement of the motor 32, i.e., the rotational amount of the output shaft thereof. The encoder 80 is preferably a rotary encoder that detects rotation in prescribed angles corresponding to the spacing of gear teeth 40 on the sun wheel 28. In other word, the encoder 80 is adapted to detect the rotational position of the sun wheel 28. The encoder 80 includes a rotating disk 82, and a timing sensor 86.

The rotating disk 82 is fixed to the second shaft 26 so as to rotate in association with the same. A plurality of slits 84 are formed in the rotating disk 82 at prescribed angular intervals in a circumferential direction thereof so as to penetrate the same in the axial direction of the second shaft 26, i.e., in a direction in which the plurality of sun wheels 28 is arranged. Each of the plurality of slits 84 corresponds to the arrangement of the gear teeth 40 on the sun wheels 28.

The timing sensor 86 detects the passing of the slits 84 in the rotating disk 82. The timing sensor 86 should be provided at a prescribed position relative to the rotating disk 82 and is preferably configured of an optical sensor, e.g. photosensor, detects slits by receiving light emitted from an LED or the like provided on the opposite side of the rotating disk 82. Alternatively, the timing sensor 86 may be a magnetic sensor that detects changes in magnetic flux at prescribed angular intervals around the rotating disk 82.

Figure 8:
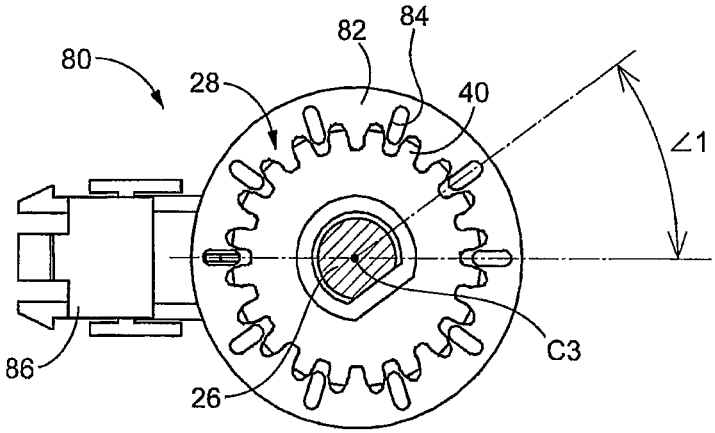
FIG. 8 is schematic view showing a positional relationship between the sun wheel and an encoder according to one or more aspects of the disclosure.

The sun wheel 28 has twenty gear teeth 40 arranged around its periphery such that the angle between neighboring teeth is 18 degrees. Ten of the slits 84 are formed in the rotating disk 82 such that an angle ∠1 between neighboring slits 84 (an angle centered on the axial center C3 of the second shaft 26) is 36 degrees. The gear teeth 40 on the sun wheel 28 have a prescribed positional relationship with the slits 84 on the rotating disk 82. Specifically, the single slit 84 is formed to correspond to the two gear teeth 40 formed on the sun wheel 28. In the example of FIG. 8, the slits 84 are arranged at positions corresponding to spaces between the gear teeth 40. Here, the number of gear teeth 40 formed on the sun wheel 28 is preferably an integer multiple of the number of slits 84 formed in the rotating disk 82. The gear teeth 40 are provided at intervals around the periphery of the sun wheel 28 and enable the encoder 80 to detect an amount of rotation corresponding to the shortest length of a sound played according to music data described later.

Figure 9:
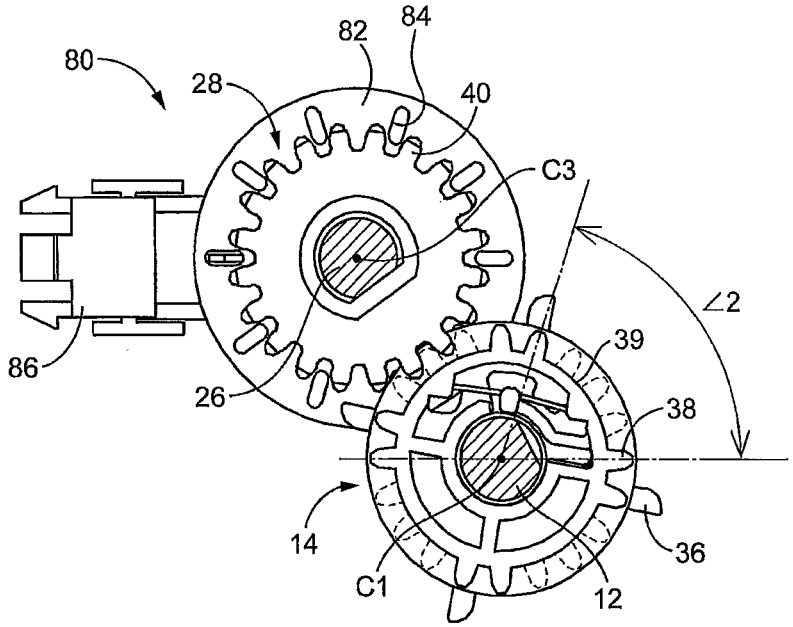
FIG. 9 is a schematic view showing a positional relationship between teeth of the sun wheel and an intermittent gear of the star wheel according to one or more aspects of the disclosure.
Figure 10:
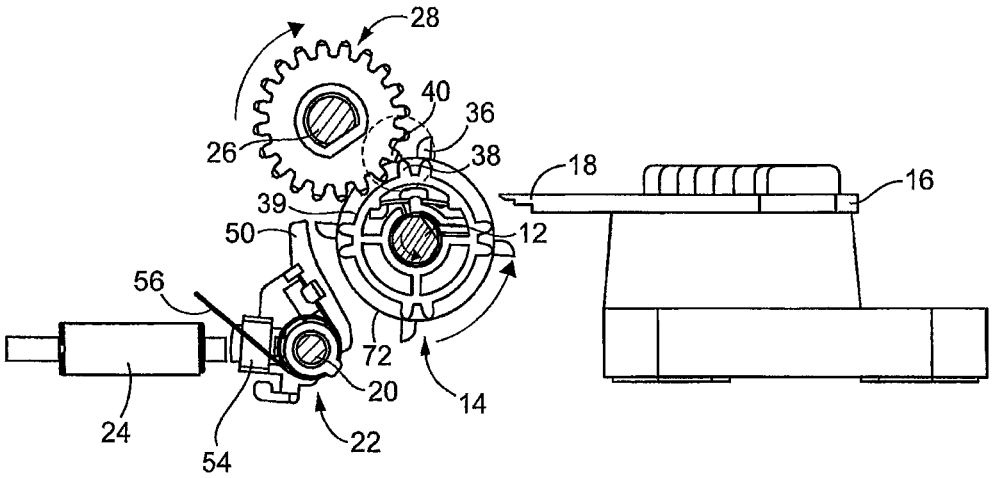
FIG. 10 is a schematic view of the mechanical performance unit when the teeth of the sun wheel and the intermittent gear are out of alignment with each other according to one or more aspects of the disclosure.

As shown in FIG. 9, the intermittent gear of the star wheel 14 includes gear teeth 38 provided in pairs about the periphery of the intermittent gear, and toothless portions 39 provided between each pair of gear teeth 38. Phantom gear teeth similar in size and shape to the gear teeth 38 are depicted in the toothless portions 39 with dashed lines, but are not actually present. In the example of FIG. 9, the intermittent gear of the star wheel 14 would have twenty gear teeth if the gear teeth were also provided in the toothless portions 39. Hence, the number of gear teeth that can be arranged around the intermittent gear of the star wheel 14 is preferably equal to the number of gear teeth 40 provided on the sun wheel 28 so that a prescribed number of gear teeth 40 on the sun wheel 28 can fit into each toothless portion 39 on the intermittent gear. In the example of FIG. 9, four gear teeth 40 fit in each toothless portion 39. An angle ∠2 of the second shaft 26 by lines passing through gear teeth 38 on either side of the toothless portion 39 (an angle centered on the rotational center C1 of the first shaft 12) is 72 degrees. Further, two slits 84 formed in the rotating disk 82 fit within each toothless portion 39 of the intermittent gear. In other words, the angle ∠2 corresponding to each toothless portion 39 is an integer multiple of the angle ∠1 between two neighboring slits 84 formed in the rotating disk 82, and is preferably two times the angle ∠1.

Figure 6:
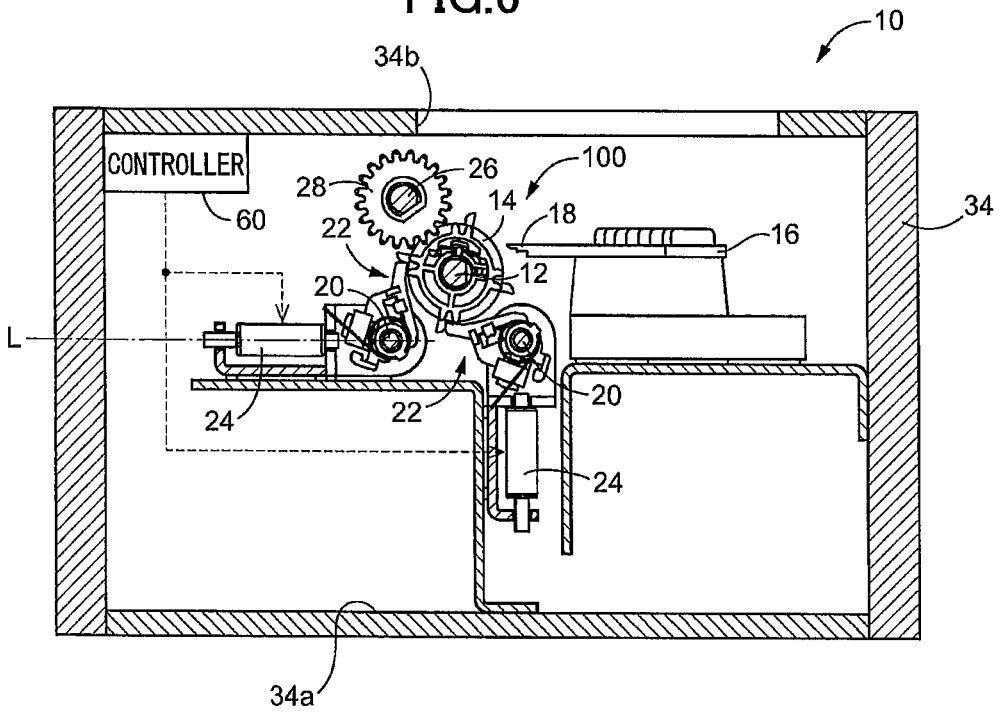
FIG. 6 is a cross-sectional view of the music box when the mechanical performance unit is accommodated in an enclosure according to one or more aspects of the disclosure.

As shown in FIG. 6, the music box 10 is provided with the enclosure 34 for accommodating therein the components of the mechanical performance unit 100, including the first shaft 12, the star wheels 14, the vibration plate 16, the third shafts 20, the stoppers 22, the electromagnets 24, the second shaft 26, and the sun wheels 28. That is, the mechanical performance unit 100 having the structure shown in FIG. 1 is accommodated inside the enclosure 34 by mounting the frame 30 on the enclosure 34. As shown in FIG. 6, the enclosure 34 includes an inner bottom surface 34*a*, and a viewing window 34*b*.

As indicated by a chain line in FIG. 6, the center of the third shaft 20 and at least some of the electromagnets 24 are arranged in the same plane, which is parallel to the inner bottom surface 34*a* of the enclosure 34. That is, some of the electromagnets 24 extending in horizontal direction are arranged in the plane indicated by the chain line, and remaining of the electromagnets 24 extending in vertical direction are shifted from the plane. Note that all of the electromagnets 24 may be arranged parallel to the inner bottom surface 34*a* of the enclosure 34.

The viewing window 34*b* is provided in the flat upper wall constituting the enclosure 34 to reveal the components inside the enclosure 34. The viewing window 34*b* is provided with a cover part (not shown) formed of glass or another transparent material. As shown in FIG. 6, the music box 10 also includes an electric control unit (ECU) 60 adapted to control the excitation and non-excitation of each electromagnet 24.

Figure 3:
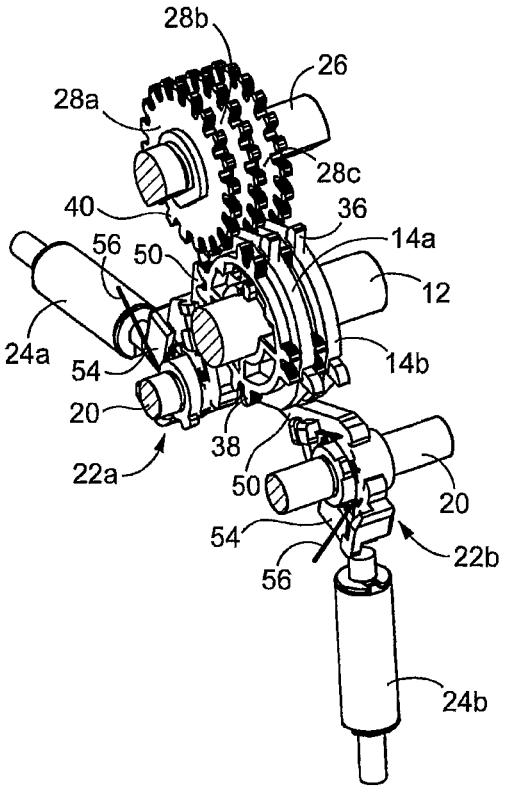
FIG. 3 is a perspective view of the mechanical performance unit shown in FIG. 2 according to one or more aspects of the disclosure.

FIG. 3 shows two star wheels 14*a* and 14*b* of the plurality of star wheels 14 and two electromagnets 24*a* and 24*b* for the corresponding engaging members 22*a* and 22*b*. In all drawings other than FIG. 3, where it is not necessary to distinguish among individual star wheels 14*a* and 14*b*, each star wheel is simply referred to using the reference numeral 14. Similarly, engaging members are simply referred to using the reference numeral 22 when it is not necessary to distinguish between individual stoppers 22*a* and 22*b*, and sun wheels are simply referred to using the reference numeral 28 when it is not necessary to distinguish among individual sun wheels 28*a*, 28*b*, and 28*c*. A star wheel 14 corresponds to a sun wheel 28, which means that the gear teeth 38 of the star wheel 14 are engaged with the gear teeth 40 of the sun wheel 28. A star wheel 14 corresponds to a stopper 22, which means that the rotation of the star wheel 14 is halted by the stopper 22 in an anchoring state.

FIG. 3 shows the sun wheels 28*a* and 28*b* engageable with the star wheels 14*a* and 14*b*, as well as the sun wheel 28*c* neighboring the sun wheel 28*b*. Here, a neighboring sun wheel 28 is defined as a sun wheel 28 positioned next to another sun wheel 28 along the second shaft 26. The vibration plate 16 and the bedplate 30 have been omitted from FIG. 3 while portions of the first shaft 12, the second shaft 26, and the third shaft 20 are also omitted (cut).

Figure 2:
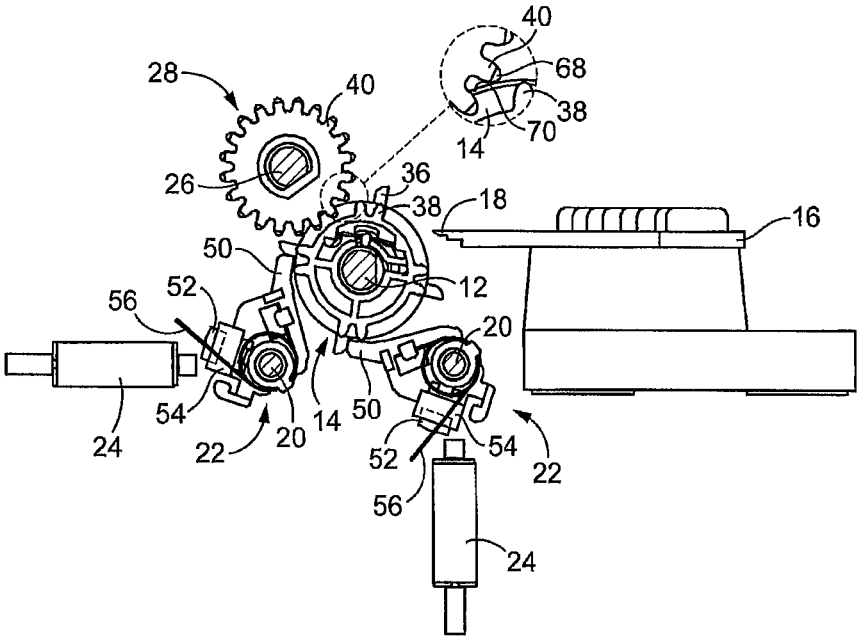
FIG. 2 is a schematic view showing a mechanical performance unit of the music box as viewed from an axial direction of a first shaft according to one or more aspects of the disclosure.

As shown in FIGS. 2 and 3, each star wheel 14 is provided with a plurality of claws 36 that protrude radially outward from the peripheral edge thereof. Preferably, four of the claws 36 are provided at equal intervals, i.e., at every 90 degrees, around the periphery of the star wheel 14 in the circumferential direction thereof. A plurality of gear teeth 38 protruding radially outward are formed at a position radially inside of the claws 36. Preferably two of the gear teeth 38 are provided at positions corresponding to each claw 36. That is, the star wheel 14 is provided with the intermittent gear teeth having the gear teeth 38 and the toothless portion 39 (FIG. 9) provided at outer circumferential surface thereof. The toothless portion 39 is not engaged with the gear teeth 40 of the sun wheel 14. The star wheel 14 is formed with an assembly hole into which the first shaft 12 is inserted, so that the star wheel 14 is mounted on the first shaft 12.

The gear teeth 38 are arranged between the star wheel 14 and the adjacent star wheel 14 in the first shaft 12 and, hence, are disposed at different positions from the claws 36 with respect to the axial direction of the first shaft 12. In other words, the gear teeth 38 are positioned between pairs of neighboring claws 36 with respect to the axial direction of the first shaft 12.

Each sun wheel 28 is provided with a plurality of gear teeth 40 around its peripheral edge. That is, the sun wheel 28 is a gear having a plurality of teeth on outer circumferential surface thereof. When the star wheel 14 is assembled on the first shaft 12 as shown in FIG. 2, the claws 36 are disposed at positions for contacting at least a portion of the vibration valve 18 aligned with the rotational path of the claws 36 upon the rotation of the star wheel 14 about the first shaft 12, i.e., the locus of the claw 36 is overlapped with the vibration valve 18. Further, the positions of the claws 36 are disposed at positions such that the stopper 22 can engage the claws 36 in the anchoring state. That is, when the stopper 22 contacts one of the claws 36, the star wheel 14 is prevented from following the rotation of the first shaft 12. By contacting the claw 36 after the claw 36 has plucked the corresponding vibration valve 18 on the vibration plate 16, the stopper 22 functions as a stopper for preventing the star wheel 14 from continuing to follow the rotation of the first shaft 12. The rotational path of the gear teeth 38 about the axial center of the first shaft 12 is aligned with the corresponding gear teeth 40 of the sun wheel 28 so that the gear teeth 38 can engage with the gear teeth 40 provided on the sun wheel 28.

As illustrated in the enlarged view of FIG. 2 (the portion encircled by a dashed line), the gear teeth 40 of the sun wheel 28 is formed with chamfered edges 68 at the distal ends of the gear teeth 40 and preferably on both sides in the axial direction of the sun wheel 28. Chamfered edges 70 are formed on the outer circumferential edges of the star wheels 14. The star wheel 68 defines an outer circumferential surface 72 formed with the chamfered edges 70. The star wheel 14 has two outer edges in the axial direction on the outer circumferential surface 72. As the sun wheel 28 and the star wheel 14 rotate, the edges of the gear teeth 40 in the axial direction of the sun wheel 28 overlap the edges of the circumferential surface 72 on the star wheel 14. Providing the chamfered edges 68 and 70 allows the gear teeth 40 to enter smoothly along the outer circumferential surface 72 without interference from the outer circumferential surface 72 or the like, thereby effectively reducing the occurrence of impact noise.

The star wheel 14 is configured so that when assembled on the first shaft 12, a prescribed frictional force is exerted between the inner peripheral surface of the assembly hole 46 and the outer peripheral surface of the first shaft 12. Specifically, the star wheel 14 is preferably provided with a friction spring for producing a frictional force between the inner peripheral surface of the assembly hole and the outer peripheral surface of the first shaft 12. The frictional force between the star wheel 14 and the first shaft 12 is stronger than the force acting to rotate the star wheel 14 and weaker than the force for disengaging the star wheel 14 from the stopper 22. With this configuration, the star wheel 14 is mounted on the first shaft 12 and can rotate about the same.

When the stopper 22 is in a non-anchoring state described later, the frictional force generated at the area of contact between the star wheel 14 and the first shaft 12 causes the star wheel 14 to rotate along with the first shaft 12. If the frictional force between the star wheel 14 and the first shaft 12 is weaker than the force for rotating the star wheel 14, there is a danger that the star wheel 14 will spin out (i.e., slide over rather than rotate together with the first shaft 12) while the star wheel 14 is disengaged from the stopper 22. Conversely, if the frictional force is stronger than the force required to extract the star wheel 14 from the stopper 22 while the stopper 22 is in the anchored state, there is a danger that the star wheel 14 will force a plate member 50 (described later) of the stopper 22 to move leftward in FIG. 2 and inadvertently disengage from the stopper 22.

As shown in FIG. 2, the stopper 22 includes a plate member 50, a magnetic member 52, a synthetic resin member 54, and a torsion coil spring 56. The plate member 50 is adapted to contact the claw 36 on the corresponding star wheel 14 by rotating the stopper 22 toward the star wheel 14 about the third shaft 20. The magnetic member 52 reacts to the magnetic force of the electromagnet 24 so as to rotate the stopper 22 in a direction for separating the stopper 22 from the star wheel 14. The magnetic member 52 is formed of metal whose primary component is an iron group element, such as iron, cobalt, or nickel. The magnetic member 52 is preferably an iron sheet that is not necessarily magnetized, but may be a permanent magnet (which is magnetized). The magnetic member 52 is formed in the synthetic resin member 54 through insert molding. In other words, the magnetic member 52 is embedded in the synthetic resin member 54. The synthetic resin member 54 is formed of an engineering plastic or the like provided integrally with the plate member 50. This construction can reduce chattering in the magnetic member 52 caused by the attraction of the electromagnet 24. The torsion coil spring 56 urges the stopper 22 to rotate toward the star wheel 14.

The electromagnet 24 is preferably configured of a cylindrical coil disposed around an iron core or other magnetic material. When electricity is supplied to the coil, the electromagnet 24 enters an excitation state in which a magnetic force (magnetic field) is produced. When electricity is not flowing through the coil, the electromagnet 24 remains in a non-excitation state. In other words, the electromagnet 24 is a common electromagnet known in the art.

As shown in FIG. 2, the electromagnet 24 is provided for each of the stoppers 22. The electromagnet 24 is positioned near the magnetic member 52 of the stopper 22, but is separated from the magnetic member 52 so as not to contact the same. In other words, the stopper is closest to the electromagnet 24 in a closest position, and then the stopper 22 does not contact the electromagnet 24 in the closest position. That is, a prescribed gap is formed between the magnetic member 52 and the electromagnet 24 whether the stopper 22 is in the anchoring state or the non-anchoring state described later. This gap should fall within a range in which the magnetic force of the electromagnet 24 can affect the magnetic member 52 when the electromagnet 24 is excited. For example, the gap should be designed such that the magnetic force of the excited electromagnet 24 will attract the magnetic member 52, even when the stopper 22 is the farthest from the electromagnet 24 in a far position. Moreover, the gap should be set such that the attracting force of the electromagnet 24 can rotate the stopper 22 in a direction away from the star wheel 14. The axial center of the electromagnet 24 (central axis of the iron core) is configured to intersect the rotational center of the stopper 22 (i.e., the axial center of the third shaft 20), as will be described later.

The torsion coil spring 56 preferably urges the stopper 22 and the plate member 50 toward the star wheel 14 when the electromagnet 24 is in the non-excitation state. Then, the plate member 50 is an anchoring state (see FIG. 2 described later) for anchoring at the claw 36 provided on the corresponding star wheel 14. The anchoring state corresponds to a standby position of the claw 36 of the star wheel 14. However, when the electromagnet 24 is in the excitation state, the magnetic force of the electromagnet 24 causes the stopper 22 and the plate member 50 to rotate about the third shaft 20 in a direction away from the star wheel 14 against the urging force of the torsion coil spring 56. The stopper 22 comes to a halt at a position in which the force of attraction on the magnetic member 52 corresponding to the magnetic force of the electromagnet 24 is counterbalanced by the urging force of the torsion coil spring 56. In this position, the stopper 22 is in the non-anchoring state (see FIGS. 4 through 5 described later) in which the plate member 50 no longer anchors the claw 36. The non-anchoring state is a state in which the halt of the star wheel 14 by the stopper 22 is released. This non-anchoring state corresponds to a state where the halt of the star wheel 14 by the stopper 22 is released.

As illustrated in FIGS. 2 and 3, the electromagnets 24 and the stoppers 22 corresponding to these electromagnets 24 belong to either a first group or a second group. The electromagnets 24 and the stoppers 22 belonging to the first group are arranged at a 90-degree phase differential about the axial center of the first shaft 12 (at a position for forming an angle of 90 degrees) with the electromagnets 24 and the stoppers 22 belonging to the second group. If the electromagnets 24 were numbered from 1 to n from one end of the second shafts 20 to the other, the electromagnets 24 with odd numbers preferably belong to the first group while those with even numbers preferably belong to the second group. Thus, the electromagnets 24, such as the electromagnets 24*a* and 24*b* in FIG. 3 corresponding to the pair of adjacent star wheels 14*a* and 14*b*, are preferably arranged apart from each other by a phase of 90 degrees about the axial center of the first shaft 12. This configuration minimizes the space required for arranging the mechanical performance unit 100 (and particularly the electromagnets 24) in the music box 10, thereby reducing the size of the music box 10.

Figure 4:
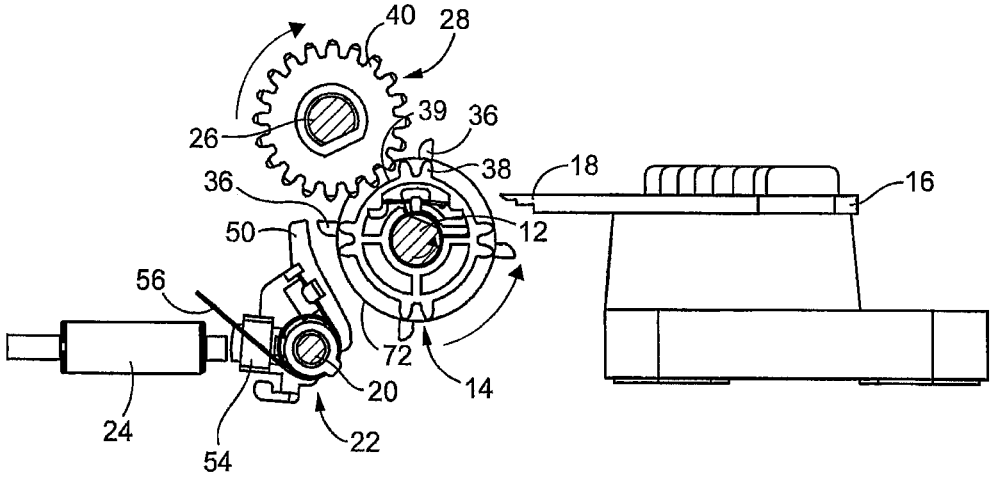
FIG. 4 is a schematic view of the mechanical performance unit when a stopper is shifted from an anchoring state to a non-anchoring state according to one or more aspects of the disclosure.
Figure 5:
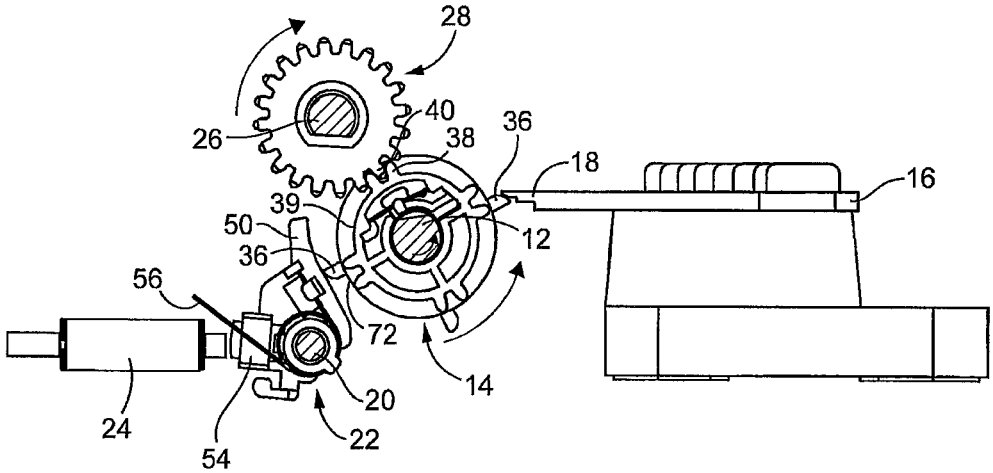
FIG. 5 is a schematic view of the mechanical performance unit when a claw of the star wheel plucks a vibration valve of a vibration plate according to one or more aspects of the disclosure.

FIGS. 2, 4, and 5 detail the operations of the mechanical performance unit 100 having the structure described above. When the music box 10 is playing music, the first shaft 12 and the second shaft 26 are constantly and synchronously driven by the motor 32 to rotate about their axial centers. As indicated by arrows in FIG. 4, the first shaft 12 and the second shaft 26 are driven to rotate in opposite directions. The first shaft 12 is preferably rotated such that the claws 36 provided on the star wheel 14 move in a direction for plucking the corresponding vibration valves 18 of the corresponding vibration plate 16 upward. The second shaft 26 is rotated so that the star wheels 14 are driven to rotate in the direction indicated by the arrow when the gear teeth 38 of the star wheels 14 are engaged with the gear teeth 40 of the corresponding sun wheels 28. Since the sun wheels 28 are incapable of rotating relative to the second shaft 26, the sun wheels 28 are constantly rotated about their axial centers as the second shaft 26 rotates about its axial center while the music box 10 is playing music.

FIG. 2 illustrates the operations of the mechanical performance unit 100 when the stopper 22 is in the anchoring state. In the state shown in FIG. 2, electricity is not being supplied to the electromagnet 24 and thus the electromagnet 24 is in the non-excitation state. At this time, the torsion coil spring 56 urges the plate member 50 of the stopper 22 so that the stopper 22 is rotated toward the star wheel 14 and at least one of the claws 36 on the corresponding star wheel 14 is anchored by the stopper 22. That is, at least one of the claws 36 contacts the distal end of the plate member 50 on the downstream side with respect to the rotating direction of the first shaft 12 (the side in which the rotation progresses).

As described above, the star wheel 14 is configured to follow the rotation of the first shaft 12 through the frictional force generated at the point of contact with the first shaft 12. In the state shown in FIG. 2, the stopper 22 is in the anchoring state for preventing the star wheel 14 from following the rotation of the first shaft 12, despite the frictional force at the contact point. That is, the star wheel 14 positioned around the axial center of the first shaft 12 rotates relative to the first shaft 12, with the surfaces of contact between the assembly hole of the star wheel 14 and the first shaft 12 sliding over each other with a light load, while the phase of the star wheel 14 (the positional relationship of the star wheel 14 relative to the vibration valve 18 and the like) remains fixed. In this state, the gear teeth 38 on the star wheel 14 are not engaged with the gear teeth 40 on the sun wheel 28 and, hence, the rotation of the sun wheel 28 does not affect the rotation of the star wheel 14. In other words, when the stopper 22 halts the star wheel 14 in the standby position on the first shaft 12, the gear teeth 40 of the sun wheel 28 rotate idly through the corresponding toothless portion 39 of the star wheel 14.

FIG. 4 illustrates the operations of the mechanical performance unit 100 when the stopper 22 is switched from the anchoring state to the non-anchoring state, i.e., the halt of the star wheel 14 by the stopper 22 is released. When electricity is conducted to the electromagnet 24 while the mechanical performance unit 100 is in the state shown in FIG. 2, the electromagnet 24 is brought into the excitation state. The magnetic force produced by the electromagnet 24 causes the plate member 50 of the stopper 22 to rotate about the third shaft 20 against the urging of the torsion coil spring 56 in a direction away from the star wheel 14. Consequently, the plate member 50 that has anchored the claw 36 disengages therefrom, enabling the star wheel 14 to rotate together with the first shaft 12 due to the frictional force generated at the area of contact between the star wheel 14 and the first shaft 12. Immediately after electricity is conducted to the electromagnet 24 in order to disengage the claw 36 and the plate member 50 from the state shown in FIG. 2, the plate member 50 preferably separates from the star wheel 14, as shown in FIG. 4.

When the stopper 22 is in the non-anchoring state shown in FIG. 4, the magnetic member 52 is in the closest position to the axial center of the electromagnet 24 at the distal end thereof. In this state, the electromagnet 24 and the magnetic member 52 are not in contact with each other, and a gap exists between the two. The magnetic member 52A has a curved surface preferably formed at nearest the electromagnet 24. The curved surface has an arc shape centered on the third shaft 20. Hence, the gap between the electromagnet 24 and the magnetic member 52 will not change when the stopper 22 is rotated about the third shaft 20.

In this operation, the stopper 22 is set to the non-anchoring state, causing the plate member 50 to disengage from the claw 36. Subsequently, the star wheel 14 begins to follow the rotation of the first shaft 12 due to the frictional force generated at the area of contact between the first shaft 12 and the star wheel 14. When the star wheel 14 is near a phase in which one of the claws 36 contacts the corresponding vibration valve 18 on the vibration plate 16, the corresponding gear teeth 38 adjacent to the claw 36 in the rotating direction (at a phase difference of 90 degrees in the rotating direction) are engaged with the gear teeth 40 on the sun wheel 28. In this state, the rotation of the sun wheel 28 drives the star wheel 14 in the direction of the arrow indicated in FIG. 5, i.e., in a direction for moving the claw 36 upward to pluck the corresponding vibration valve 18 on the vibration plate 16. In other words, the claw 36 of the star wheel 14 plucks the corresponding vibration valve 18 while the gear teeth 40 of the sun wheel 28 are engaged with the gear teeth 38 on the star wheel 14. Through this operation, a sound at the tone corresponding to the vibration valve 18 is played.

After the vibration valve 18 is plucked in this way, the star wheel 14 continues following the rotation of the first shaft 12 and the sun wheel 28 follows the rotation of the second shaft 26 until the gear teeth 38 are again no longer engaged with the gear teeth 40 on the sun wheel 28. During the process of transitioning from the state shown in FIG. 5 to the state in which the gear teeth 38 are no longer engaged with the gear teeth 40, conducting electricity to the electromagnet 24 is halted and the electromagnet 24 returns to a non-excitation state. Consequently, the urging of the torsion coil spring 56 rotates the stopper 22 toward the star wheel 14, returning the mechanical performance unit 100 to the state shown in FIG. 2.

Figure 7:
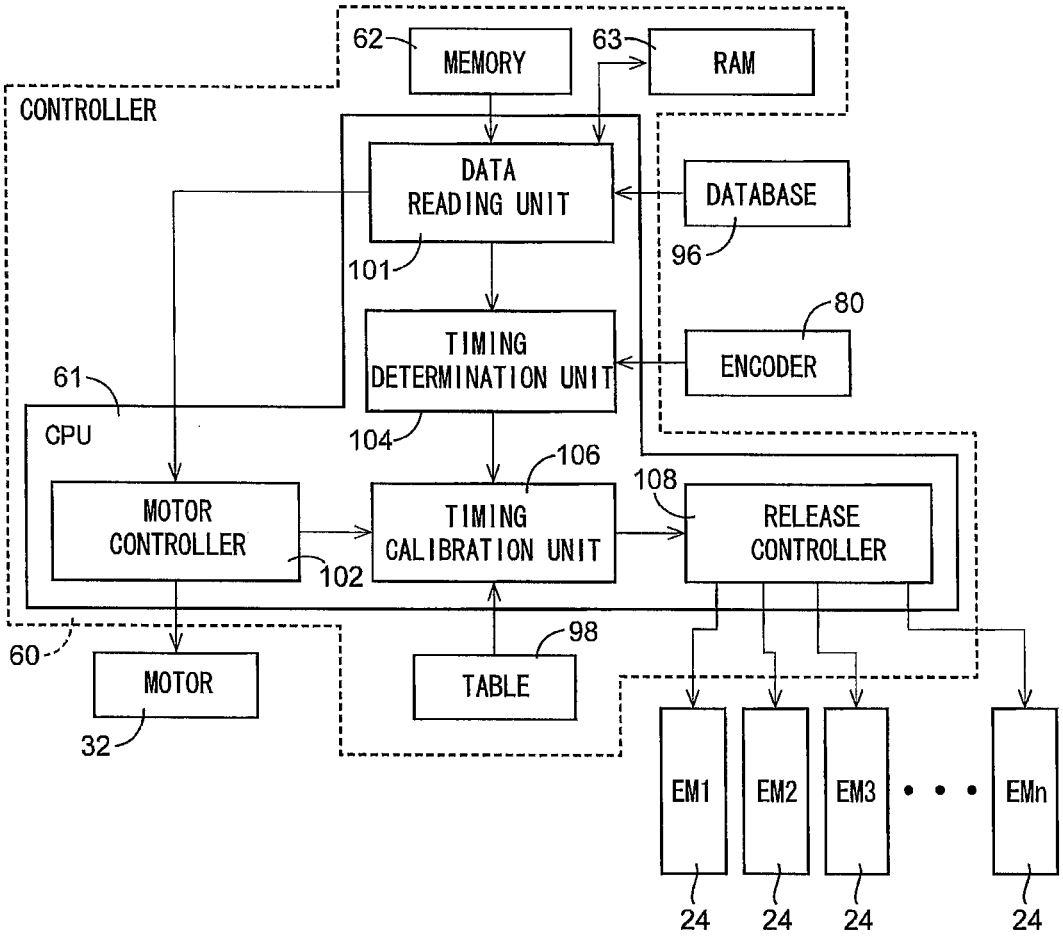
FIG. 7 is a functional block diagram showing an electrical structure of a controller according to one or more aspects of the disclosure.

As shown in FIG. 7, the controller 60 includes a CPU 61, a flash memory 62, a RAM 63, and a calibration table 98. The CPU 61 executes a process for setting the speed at which the motor 32 rotates and the timings for releasing the star wheels 14 based on MIDI (Musical Instrument Digital Interface) data. The major functional units controlled by the CPU 61 of the controller 60 are indicated inside the CPU 61 in FIG. 7 and include a data-reading unit 101, a motor controller 102, a timing determination unit 104, a timing calibration unit 106, and a release controller 108. The flash memory 62 stores programs executed by the CPU 61, and various tables described later.

The controller 60 is electrically connected to a music database 96, the encoder 80, and the motor 32. The music database 96 holds music data (musical score data) for a plurality of music that the music box 10 can play. The music database 96 is stored on a storage medium, such as an SD card (Secure Digital card) detachable from the music box 10, and the controller 60 is capable of reading the music data stored on the storage medium. Music data may be stored in a data format such as MIDI and may include a plurality of tracks (channels) for a predetermined plurality of instrument types, wherein the sound output timing, tone, and the like for sounds is specified for each instrument. In the following description, MIDI data is used as an example of the music data.

The music data stored in the music database 96 includes the tempo (playback tempo) of the corresponding music in the music data. The playback tempo is a value specified in the conductor track found in the header (header chunk) of the MIDI data and is within 40-120 bpm (bit per minute), for example. The music data stored in the music database 96 also includes timing data specifying the note-playing timing at which prescribed notes are played. The note-playing timing is specified by Note On events in the MIDI data, for example. The sound length between a Note On event for a prescribed sound specified in the music data and a Note On event for the next sound is represented in units of time called "ticks," for example. Ticks are determined based on the tempo and time base (resolution) of the music data. The length of one tick (in seconds) is equal to 60/(tempo×time base), for example. If a reference time base corresponding to a quarter note in length is set to 480 ticks in the score specified by the music data, the length of the sixteenth note should correspond to 120 ticks.

The shortest length of a sound in the music data is set to a length equivalent to one-third the length of a sixteenth note in the preferred embodiment. In other words, the time elapsed after the encoder 80 detects the passage of one slit 84 and until the encoder 80 detects the passage of the next slit 84 is 40 ticks. Thus, the shortest sound length in the musical score defined in the music data preferably corresponds to 40 ticks. When the time base is set to a prescribed value, the time elapsed between playing a prescribed note and the next note is determined based on the playback tempo and the sound length between Note On events for two notes. Hence, it is possible to find the time interval between the moment a vibration valve 18 on the vibration plate 16 is plucked and the moment the next vibration valve 18 (the same or a different vibration valve 18) is plucked. The time between the playing of one note and the next note as specified in the music data differs according to the playback tempo. Thus, the time between notes corresponding to a prescribed sound length becomes shorter as the tempo becomes faster and longer as the tempo becomes shorter. In other words, the length of time for tick is determined from the time base and the tempo stored in the music data. The sun wheels 28 are driven to rotate based on this determined length of time so that the time elapsed after the encoder 80 detects the passage of one slit 84 until the encoder 80 detects the passage of the next slit 84 corresponds to the target tempo. Further, a modified tempo for changing the playback tempo of music data while the music is playing may be specified in the music data as a Tempo Change event.

When the music box 10 plays music, the data-reading unit 101 reads music data corresponding to the desired music to be played from the music database 96. For example, the data-reading unit 101 reads MIDI data corresponding to music data for the desired music from the music database 96 and develops this data in the RAM 63 of the controller 60, for example. The data-reading unit 101 may also be configured to read sequential portions of MIDI data to be played corresponding to the desired music from the music database 96 as needed while the music box 10 is playing the music.

The motor controller 102 controls the rotational speed of the motor 32 and, hence, the speed at which the first shaft 12 and the second shaft 26 are driven to rotate by the motor 32. Thus, when the music box 10 plays music corresponding to prescribed music data stored in the music database 96, the motor controller 102 controls the rotational speed of the motor 32 so that the first shaft 12 and the second shaft 26 are rotated at a speed based on the tempo set in the music data. The motor controller 102 controls the motor 32 to rotate at a faster rotational speed as the tempo in the music data becomes faster. In other words, the first shaft 12 and the second shaft 26 are driven to rotate at a speed based on the tempo at which the music data is to be played. The music box 10 is preferably provided with a speed control table (not shown) that stores the rotational speed of the motor 32 corresponding to each tempo. The motor controller 102 determines the rotational speed of the motor 32 by referencing the speed control table based on the tempo specified in the MIDI data read by the data-reading unit 101 and drives the motor 32 so that the motor 32 rotates at this speed. Alternatively, the motor controller 102 may calculate the rotational speed of the motor 32 based on the tempo set in the MIDI data using a preset equation or the like.

The motor controller 102 uses feedback control to control the rotational speed of the motor 32. Preferably, the motor controller 102 detects the rotational speed of the drive shaft in the motor 32 at short intervals (every complete rotation, for example) and controls the rotation of the motor 32 so that the speed of the drive shaft matches the target rotational speed corresponding to the playback tempo. Particularly, when the motor 32 rotates a plurality of times to rotate the sun wheel 28 one time owing to the reduction ratio, controlling the rotational speed of the motor 32 through feedback on the rotational speed of the drive shaft enables the motor controller 102 to control the rotation of the sun wheel 28 more accurately. Preferably, the reduction ratio is determined such that the motor 32 is rotated a plurality of times while the sun wheel 28 rotates from the point that the encoder 80 detects one slit 84 to the point that the encoder 80 detects the next slit 84. In this case, feedback on the rotation of the motor 32 can be received a plurality of times in the interval between detected slits 84 to achieve more accurate control of the rotational speed. Thus, in the interval between the moment that the encoder 80 detects one slit 84 and the moment the encoder 80 detects the next slit 84, the motor controller 102 can drive the sun wheel 28 to rotate at an accurate speed.

Another encoder or resolver separate from the encoder 80 that has a high resolution of slits provided at equal intervals around its circumference may also be used to detect the rotational speed of the drive shaft in the motor 32. Further, if the motor 32 is rotated based on a prescribed drive pulse (output pulse from an encoder or the like), the motor controller 102 may calculate the rotational speed of the drive shaft in the motor 32 based on the actual drive pulse. With this configuration, the motor controller 102 can drive the sun wheel 28 to rotate accurately at a speed by which the interval between slits 84 detected by the encoder 80 is one-third the sound length of a sixteenth note in the music data. The motor controller 102 preferably drives the sun wheel 28 to rotate accurately at a speed by which the interval between slits 84 detected by the encoder 80 is equivalent to the shortest sound length (40 ticks in this example).

When the tempo specified in the music data is modified, the motor controller 102 changes the rotational speed of the motor 32 according to the change in tempo. For example, when the tempo change event is read by the data reading unit 101 during a performance based on MIDI data, the motor controller 102 modifies the rotational speed of the motor 32 based on the tempo change in the tempo change event when the timing for executing the tempo change event has arrived and, hence, modifies the rotational speeds of the first shaft 12 and the second shaft 26 driven by the motor 32 based on the changed tempo.

The music box 10 is preferably provided with an input operation unit (not shown) through which a user can input a command to change the playback tempo of the mechanical performance unit 100. By performing an input operation on this input operation unit, the user can modify the tempo played by the mechanical performance unit 100 to a slower or faster tempo than the playback tempo set in the MIDI data in a plurality (seven, for example) of steps at prescribed intervals. Alternatively, the input operation unit may be configured to accept input of a numeral corresponding to the tempo (bit per minute), such as 40 or 120, enabling the user to modify the tempo freely rather than by steps. By performing an input operation on the input operation unit to modify the playback tempo, the user can change the tempo played by the mechanical performance unit 100 even though the tempo is fixed in the music data. Specifically, when the user inputs a command on the input operation unit to modify the playback tempo, the motor controller 102 changes the rotational speed of the motor 32 based on this change in tempo.

The timing determination unit 104 determines a start timing (timing for starting an operation) for each of the stoppers 22. At this timing, the stopper 22 releases the claw 36 on the corresponding star wheel 14. More specifically, the timing determination unit 104 determines the start timing for an operation to switch the state of the electromagnet 24 corresponding to one of the stoppers 22 to the excitation state or the non-excitation state (the timing to start or halt the supply of electricity to the electromagnet 24). For example, as the music box 10 is playing music corresponding to prescribed music data stored in the music database 96, the timing determination unit 104 performs the above determinations based on the note-playing timing (sound output timing, Note ON event) and tone specified in the music data. More specifically, the timing determination unit 104 determines the timings at which the stoppers 22 release corresponding claws 36 on star wheels 14 in order that the star wheels 14 can pluck vibration valves 18 corresponding to the musical tones at sound output timings specified in the music data.

The timing determination unit 104 controls the start timing of each stopper 22 for releasing the corresponding star wheel 14, allowing the star wheel 14 to rotate, based on the passage of the slit 84 detected by the encoder 80. Specifically, the timing determination unit 104 determines the rotational amount of the sun wheels 28 based on the passage of the slit 84 detected by the encoder 80 and determines the start timing of each stopper 22. Since the encoder 80 is provided on the second shaft 26, which is the rotational shaft of the sun wheels 28, the slit positions in the encoder 80 are relative to the positions of the tips of the gear teeth 40 provided on the sun wheels 28. The timing determination unit 104 sets the timing at which each star wheel 14 is to begin rotating by identifying the tip positions of gear teeth 40 on the sun wheels 28 based on the passage of the slit 84 detected by the encoder 80. In other words, the timing determination unit 104 controls the start timing of each stopper 22 for releasing the corresponding star wheel 14 based on the tempo specified in the music data (i.e., the rotational speed of the second shaft 26), and the rotational amount of the sun wheels 28. Alternatively, the encoder 80 may detect the rotational amount of the sun wheel 28 and the timing determination unit 104 may determines the start timing of each stopper 22 based on the rotational amount detected by the encoder 80.

The timing determination unit 104 sets the start timing for the stopper 22 to release the corresponding star wheel 14 based on the timing at which the encoder 80 detects the passing of slits 84 such that the gear teeth 38 of the star wheel 14 engage precisely with the gear teeth 40 on the sun wheel 28. For example, the timing determination unit 104 sets the start timing at which the stopper 22 releases the halt of the rotation of the star wheel 14 when the encoder 80 detects the passing of at least one slit 84 after the sound output timing of a prescribed note in the music data has passed. In the preferred embodiment, the timing determination unit 104 preferably sets the timing at which the stopper 22 releases the halt of the rotation of the star wheel 14 to the timing at which the timing determination unit 104 determines a rotational amount corresponding to the shortest sound length in the music data based on the passage of the slit 84 detected by the encoder 80, i.e., a rotational amount equivalent to one-third the sound length of a sixteenth note in the music data. For example, the timing determination unit 104 determines the timing at which each stopper 22 is to release the halt of the rotation of the star wheel 14 based on a rotational amount that is equivalent to 40 ticks (approximately 40 ms for a playback tempo of 120) specified in the music data. When the mechanical performance unit 100 is playing a sound whose sound length is specified as 40 ticks in the music data, as illustrated in the example of FIG. 8, the timing determination unit 104 determines the start timing at which the stopper 22 releases the halt of the rotation of the star wheel 14 based on the timing at which the encoder 80 detects the passing of one slit 84 (i.e., the time elapsed after the encoder 80 detects the passing of one slit 84 until the encoder 80 detects the next slit 84).

The timing determination unit 104 preferably determines the start timing at which the stopper 22 releases the halt of the rotation of the star wheel 14 when the encoder 80 has detected a passage of the slits 84 corresponding to the sound length of a note in the music data to be played based on the tempo at which the music data is to be played, the length of the note specified in the music data, and the rotational amount of the sun wheel 28. For example, the timing determination unit 104 determines the start timing at which the stopper 22 releases the halt of the rotation of the corresponding star wheel 14 based on the rotational amount of the sun wheel 28 that is equivalent to 120 ticks specified in the music data (approximately 120 ms at a playback tempo of 120). In the example illustrated in FIG. 8, if the mechanical performance unit 100 is playing a note whose sound length specified in the music data is 120 ticks, then the timing determination unit 104 determines the start timing at which the stopper 22 releases the halt of the rotation of the star wheel 14 based on when the encoder 80 detects the passing of four slits 84 (the passing of three slits 84 after the encoder 80 has detected the passing of an initial slit 84).

In the mechanical performance unit 100 described above, a prescribed time (dead time) passes after the operation of the stopper 22 is initiated to release the halt of the star wheel 14 until the stopper 22 is actually disengaged from the corresponding star wheel 14 and the star wheel 14 actually begins to rotate. That is, the prescribed time is required after the electromagnet 24 is placed in the excitation state (turned on) in order to release the anchoring state of the stopper 22 (switch the stopper 22 to the non-anchoring state) until the magnetic force produced by the electromagnet 24 attracts the synthetic resin member 54 such that the stopper 22 is rotated in the direction away from the star wheel 14 and disengaged therefrom, allowing the star wheel 14 to begin to follow the rotation of the first shaft 12. This prescribed time is determined according to the specifications of the electromagnet 24, the stopper 22, the star wheel 14, and the like, but does not vary significantly as a result of the rotational speed of the motor 32 or the like.

On the other hand, the rotational speed of the sun wheel 28 varies according to the playback tempo. Consequently, the amount that the sun wheel 28 rotates during this prescribed time differs according to the rotational speed of the motor 32 determined by the playback tempo. Hence, when the timing determination unit 104 always sets the start timing (time delay) for an operation to release the stopper 22 from the anchoring state according to this prescribed timing without regard for the playback tempo, the teeth of the star wheel 14 and the sun wheel 28 may become out of alignment because the rotational amount of the sun wheel 28 differs according to the rotational speed thereof.

Figure 11:
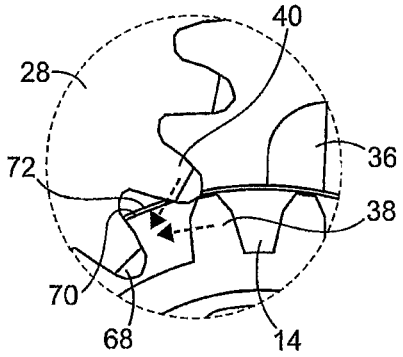
FIG. 11 is a partial enlarged view of an encircled region depicted in dotted line of FIG. 10 according to one or more aspects of the disclosure.

In the example shown in FIG. 11, the gear tooth 38 on the star wheel 14 collides with the gear tooth 40 on the sun wheel 28. If the star wheel 14 and the sun wheel 28 are allowed to continue rotating in this state, the gear teeth 38 and the gear teeth 40 will continue to impact each other. These impacts may generate noise, cause damage to the gears, and other unwanted results. Therefore, the music box 10 according to the preferred embodiment is provided with the timing calibration unit 106 described next in greater detail. The timing calibration unit 106 calibrates the timing at which the stoppers 22 are released based on the playback tempo and other factors in order to prevent the teeth on corresponding star wheels 14 and the sun wheels 28 from becoming misaligned.

The timing calibration unit 106 calibrates the start timing set by the timing determination unit 104 based on a value related to the rotational speed of the motor 32. The rotational speed of the motor 32 is the speed at the point that the encoder 80 detects the passing of the slit 84, for example. The timing calibration unit 106 preferably calculates the difference (time delay) between the start timing set by the timing determination unit 104 and the timing at which the release controller 108 described later actually begins the operation to release the stopper 22 from the anchoring state.

Figure 12:
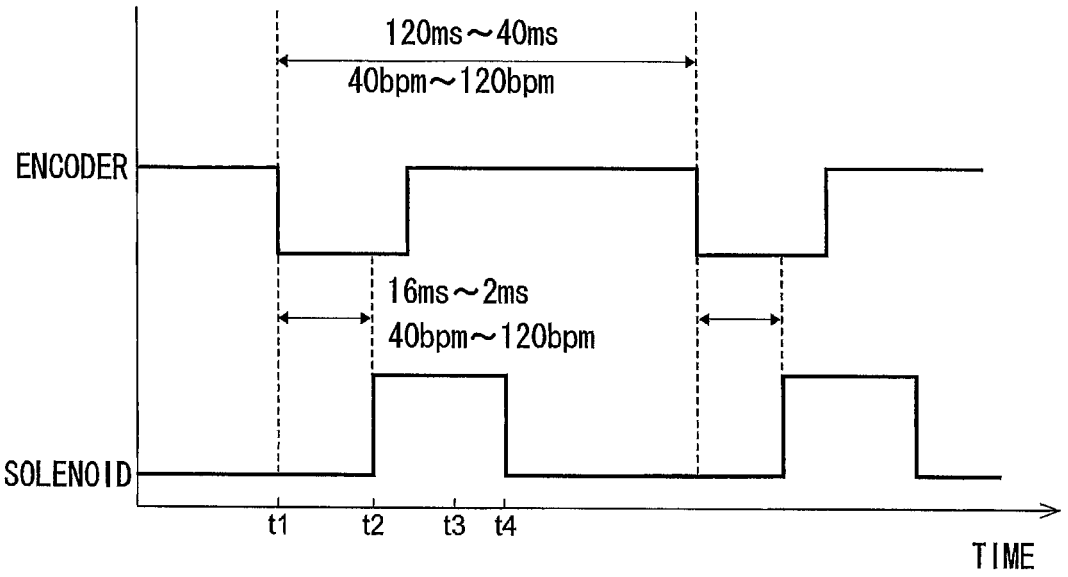
FIG. 12 is a time chart illustrating a calibration of a start timing of the stopper by the controller according to one or more aspects of the disclosure.

As shown in FIG. 12, the timing calibration unit 106 calibrates the start timing of each stopper 22 so that the release controller 108 begins an operation to release the stopper 22 once a prescribed time delay of 2-16 ms, for example, has elapsed after the encoder 80 detects the passage of the slit 84. The time interval at which the encoder 80 detects passing of slits 84 varies according to the rotational speed of the motor 32 corresponding to the playback tempo of the music being currently played. Accordingly, the timing calibration unit 106 sets a calibration amount (amount of delay) for the start timing based on a value related to the rotational speed of the motor 32. The value related to the rotational speed of the motor 32 may be the actual rotational speed of the motor 32, the magnitude of electricity supplied to the motor 32, the rotational amount of the sun wheel 28, or the rotational speed of the sun wheel 28 corresponding to this rotational amount, for example.

Next, the operations of the mechanical performance unit 100 that correspond to the timing chart in FIG. 12 will be described. At a timing t1 in FIG. 12, the encoder 80 detects passing of one slit 84. At this time, the stopper 22 is in the anchoring state shown in FIG. 2 and rotation of the star wheel 14 is halted. The sun wheel 28 continues to rotate from the timing t1 to a subsequent timing t2. The rotational amount of the sun wheel 28 during this interval differs according to the rotational speed of the motor 32 based on the playback tempo. At the timing t2, the release controller 108 conducts electricity to the electromagnet 24, placing the electromagnet 24 in the excitation state. After a prescribed dead time has elapsed, the stopper 22 is released from the anchoring state, as shown in FIG. 4. At a timing t3, the gear teeth 38 of the star wheel 14 and the gear teeth 40 of the sun wheel 28 is brought into engagement with each other, as shown in FIG. 5, and then the claw 36 on the star wheel 14 driven by the sun wheel 28 plucks the corresponding vibration valve 18. At a timing t4, electricity supplied to the electromagnet 24 is halted, placing the electromagnet 24 in the non-excitation state and returning the stopper 22 to the anchoring state shown in FIG. 2. The timing calibration unit 106 calibrates the start timing at the timing t2 to start conducting electricity to the electromagnet 24 with consideration for the rotational amount of the sun wheel 28 between timing t1 and the timing t2 in order that the gear teeth 38 of the star wheel 14 are precisely aligned with the gear teeth 40 on the sun wheel 28 at the timing t4.

Figures 13, 14:
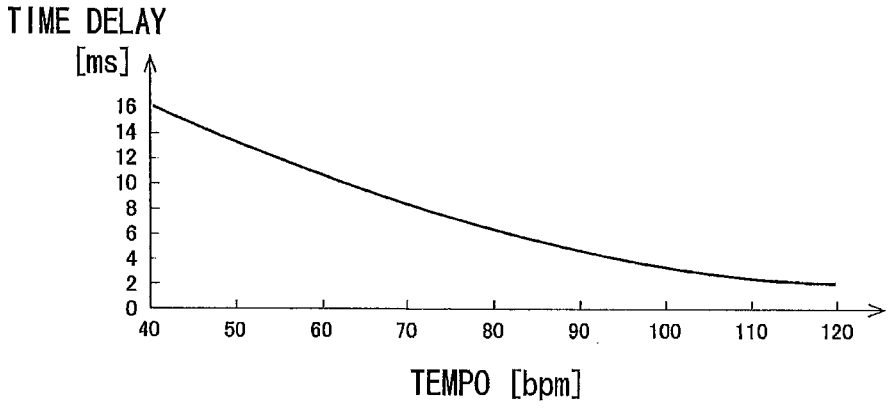
FIG. 13 is a calibration table showing a relationship among a current speed, a target speed and a calibration amount according to one or more aspects of the disclosure.
FIG. 14 is a graph showing a correlation between an actual tempo of a music played by the music box and a time delay for the start timing according to one or more aspects of the disclosure.

As shown in FIG. 13, the calibration table 98 provided in the music box 10 records calibration amounts predetermined through experimentation for calibrating the start timing in order to convert the pre-change playback tempo (current speed) to the post-change playback tempo (target speed). The calibration table 98 in FIG. 13 indicates correlations for deriving the calibration amount of the start timing during a transitional phase in which the playback tempo of the music box 10 is changed, and correlations for deriving the calibration amount of the start timing for each playback tempo during a constant-speed state during which the playback tempo is not changed. Hence, the calibration table 98 in FIG. 13 includes a constant rate calibration table with preset calibration amounts of the start timing corresponding to each of prescribed playback tempos. Correlations in the calibration table 98 in which the current speed matches the target speed (correlations lying on the diagonal from the top left to the bottom right in FIG. 13) correspond to the constant rate calibration table.

The timing calibration unit 106 acquires the calibration amount from the correlations set in the calibration table 98 based on the playback tempo for the song currently played by the music box 10 and calibrates the start timing based on this calibration amount. While the music box 10 is in a constant-speed state during which the playback tempo does not change (a state of uniform tempo), the timing calibration unit 106 acquires the calibration amount from the correlations set in the calibration table 98 (constant rate calibration table) based on the playback tempo at the current time and calibrates the start timing based on the acquired calibration amount.

FIG. 14 is a graph showing a sample correlation between the playback tempo of the music played by the music box 10 and a suitable time delay for the start timing that is found through experimentation. Since the sun wheel 28 rotates a greater amount over a given time as the playback tempo becomes faster, the suitable time delay for the start timing becomes shorter for a faster playback tempo. Accordingly, the calibration values are set in the calibration table 98 for each of the prescribed playback tempos such that the time delay is reduced for faster playback tempos. The timing calibration unit 106 preferably calibrates the start timing set by the timing determination unit 104 so that the actual start timing of the release controller 108 occurs after the original start timing by the calibration value (time delay) acquired from the calibration table 98. In other words, the timing calibration unit 106 performs a control process to set, to the calibrated value (time delay) acquired as described above, the time interval between the moment that the encoder 80 detects passing of the slit 84 and the moment that the release controller 108 begins supplying electricity to the electromagnet 24 for releasing the stopper 22 from the anchoring state. Simply put, the actual start timing for the release controller 108 is set by adding the time delay acquired above to the start timing set by the timing determination unit 104.

During a transitional phase in which the playback tempo of the music box 10 is changed, the timing calibration unit 106 acquires the calibration amount from correlations set in the calibration table 98 based on the playback tempo prior to this change (current speed) and the playback tempo after the change (target speed), and calibrates the start timing based on the acquired calibration amount. The calibration values set in the calibration table 98 are designed to delay the start timing from that used at the pre-change playback tempo when the tempo is being changed to a slower tempo, and to advance the start timing from that used at the pre-change playback tempo when the tempo is being changed to a faster tempo.

As shown in FIG. 13, the calibration values are preferably set in the calibration table 98 such that the start timing is later when changing the playback tempo to a slower tempo than that when the playback tempo is not changed, and sooner when changing the playback tempo to a faster tempo than that when the playback tempo is not changed. Accordingly, the timing calibration unit 106 preferably calibrates the start timing to a value later than a reference start timing for starting the operation of the stopper 22 at the playback tempo corresponding to the music data if the playback tempo is changed to a slower tempo while the motor 32 is rotating at a speed based on the playback tempo set in the music data, whereas the timing calibration unit 106 calibrates the start timing to a value sooner than the reference start timing if the playback tempo is changed to a faster tempo while the motor 32 is rotating at a speed based on the playback tempo set in the music data.

Figure 16:
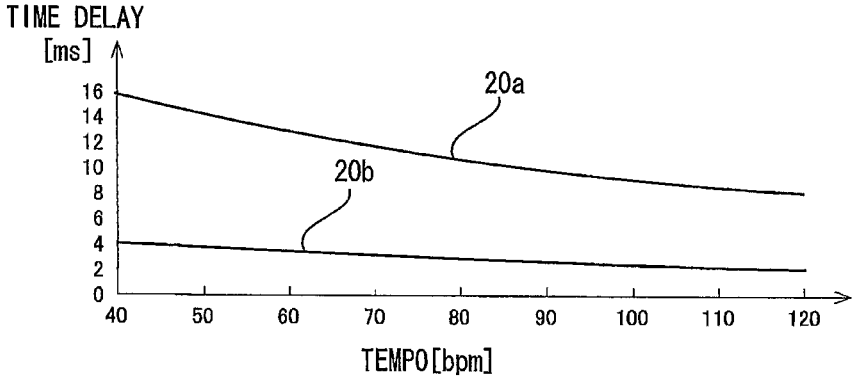
FIG. 16 is a graph showing correlations between an actual tempo of music played by the music box and the time delay for the start timing according to one or more aspects of the disclosure.

When the playback tempo of the music box 10 is changed, the rotational speed of the motor 32 changes in response to this change in tempo. While the encoder 80 is detecting the passing of slits 84 during this transitional phase, a suitable time delay will vary depending on the direction and range of the change in the rotational speed of the motor 32. A line 20*a* shown in FIG. 16 is a sample time delay suitable for the start timing of the stopper 22 when the playback tempo of the music box 10 is raised from 40 bpm. As indicated by the line 20*a*, the suitable time delay is 16 ms when the tempo remains unchanged at 40 bpm, 10 ms during a transitional phase in which the tempo rises from 40 to 80 bpm, and 7 ms during a transitional phase in which the tempo rises from 40 to 120 bpm. A line 20*b* shown in FIG. 16 indicates a suitable time delay for the start timing of the stopper 22 when the playback tempo of the music box 10 is lowered from 120 bpm. As indicated by the line 20*b*, the suitable time delay is 2 ms when the playback tempo remains unchanged at 120 bpm, 3 ms during a transitional phase in which the playback tempo is lowered from 120 to 70 bpm, and 4 ms during a transitional phase in which the tempo is lowered from 120 to 40 bpm. These values are found through experiments performed in advance and set in the calibration table 98.

Figure 15:
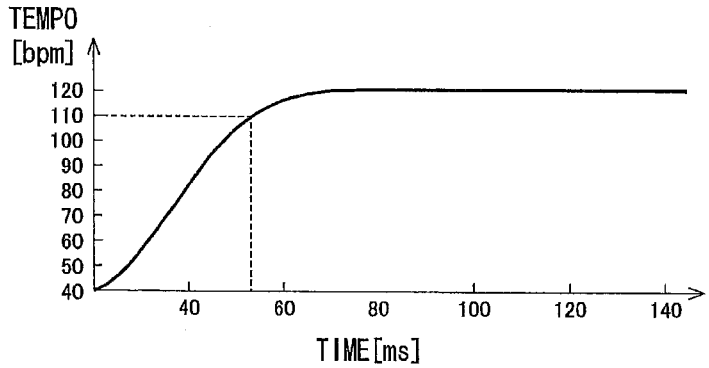
FIG. 15 is a graph showing a waveform corresponding to the actual tempo of the music box as a playback tempo rises from 40 to 120 bpm according to one or more aspects of the disclosure.

As shown in FIG. 15, when the playback tempo is modified in the accelerating direction, the rotational speed of the motor 32 (actual tempo) rises abruptly after the motor controller 102 outputs a command to adjust the speed. The dashed line in FIG. 15 indicates the tempo upon plucking the vibration valve 18 by the claw 36 of the star wheel 14 if the tempo begins rising at a timing 0 and simultaneously the electromagnet 24 is in the excitation state for releasing the stopper 22. In the example shown in FIG. 15, the playback tempo has risen to 110 bpm at the stage that the claw 36 plucks the vibration valve 18 (the stage in which the star wheel 14 and sun wheel 28 are engaged).

Since the rotational speed of the motor 32 rises abruptly in response to a speed change command when the playback tempo of the music box 10 is changed in the accelerating direction, as described above, suitable time delays for the start timing of the stopper 22 in response to this increased speed are found through experimentation considering such abrupt rises and recorded in the calibration table 98. Thus, the timing calibration unit 106 determines the actual start timing of the release controller 108 by applying a time delay acquired as described above to the start timing set by the timing determination unit 104.

Figure 17:
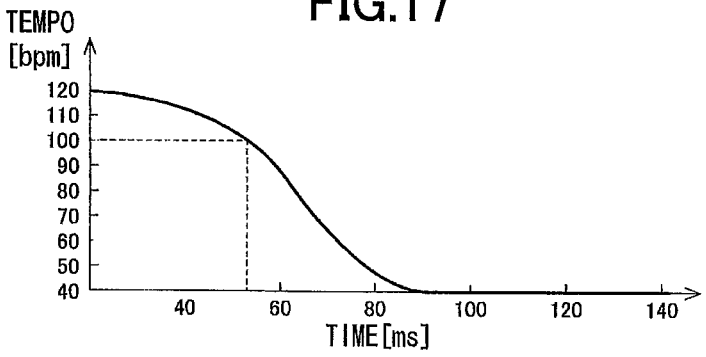
FIG. 17 is a graph showing a waveform corresponding to the actual playback tempo of the music box when the tempo is lowered from 120 to 40 bpm according to one or more aspects of the disclosure.

As shown in FIG. 17, the rotational speed of the motor 32 (actual tempo) drops gradually after the motor controller 102 outputs the speed change command when the playback tempo is changed in the decelerating direction. The dashed line in FIG. 17 indicates the tempo upon plucking the vibration valve 18 by the claw 36 of the corresponding star wheel 14 if the decrease in tempo begins at the timing 0 and simultaneously the electromagnet 24 is in the excitation state for releasing the stopper 22. In the example of FIG. 17, the playback tempo has only dropped to 100 bpm by the time the claw 36 plucks the corresponding vibration valve 18. In other words, the tempo does not drop from 120 to 40 bpm by the time the claw 36 plucks the corresponding vibration valve 18.

Thus, when changing the playback tempo of the music box 10 in the decelerating direction as described above, the playback tempo may not reach the target speed by the time the claw 36 plucks the corresponding vibration valve 18 due to the gradually reduction of the playback tempo. Accordingly, suitable time delays for the start timing of the stopper 22 are found through experimentation based on the above correlations and recorded in the calibration table 98. The timing calibration unit 106 determines the actual start timing for the release controller 108 by applying a time delay acquired as described above to the start timing set by the timing determination unit 104. Hence, while wheels are particularly susceptible to becoming out of alignment during transitional phase in which the playback tempo is changed, the above control process can suitably suppress such misalignment.

The release controller 108 initiates the operation to release the stopper 22 from the anchoring state at the start timing calibrated by the timing calibration unit 106. Specifically, the timing determination unit 104 determines the start timing at which the stopper 22 releases the claw 36 of the star wheel 14, the timing calibration unit 106 calibrates this start timing, and then the release controller 108 begins conducting electricity to the corresponding electromagnet 24 at the calibrated start timing for switching the electromagnet 24 from the non-excitation state to the excitation state.

For example, after the timing determination unit 104 determines the start timing at which the stopper 22 is to release the claw 36 of the star wheel 14 and the timing calibration unit 106 calculates a calibration amount (time delay) for calibrating the start timing, the release controller 108 starts conducting electricity to the corresponding electromagnet 24 for switching the electromagnet 24 to the excitation state when the time delay has elapsed. After the release controller 108 switches the electromagnet 24 from the non-excitation state to the excitation state, the release controller 108 preferably switches the electromagnet 24 back to the non-excitation state after a predetermined time has elapsed. Hence, electricity supplied to the electromagnet 24 is halted at this time.

Figure 18:
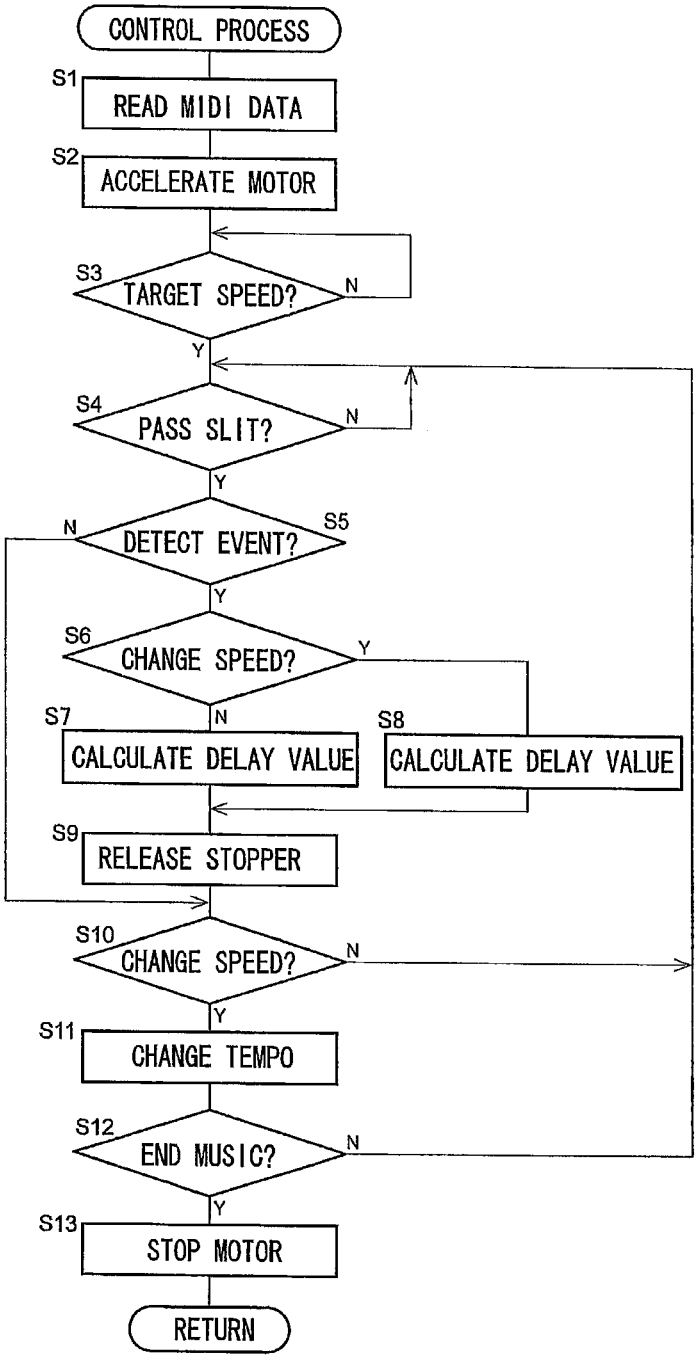
FIG. 18 is a flowchart showing steps in a music box control process executed by the controller according to one or more aspects of the disclosure.

The flowchart in FIG. 18 illustrates the primary steps in a music box control process executed by the CPU 61 of the controller 60 provided in the music box 10. The music box control process is executed repeatedly at prescribed intervals.

In step S1 (hereinafter "step" will be omitted) of the control process, the CPU 61 reads MIDI data (music data) for the music to be played from the music database 96. In S2 the CPU 61 accelerates the motor 32 to a target speed (playback starting speed) corresponding to the playback tempo set in the MIDI data read in S1. In S3 the CPU 61 determines whether the rotational speed of the motor 32 has reached the target speed. The CPU 61 repeatedly performs the determination of S3 while waiting for the rotational speed of the motor 32 to reach the target speed. Once the motor 32 has reached the target speed, in S4 the CPU 61 determines whether the encoder 80 (timing sensor 86) has detected the passage of the slit 84. The CPU 61 repeatedly executes the determination in S4 while waiting until the encoder 80 detects the slit 84. When the encoder 80 detects the passing of a slit 84 in S4, the CPU 61 executes the remaining process beginning from S5.

In S5 the CPU 61 determines whether there is a note in the MIDI data to be played. For example, the CPU 61 determines whether a Note On event has been detected. The CPU 61 skips to S10 when the determination in S5 is negative. However, if the CPU 61 determines in S5 that there is a note to be played, in S6 the CPU 61 determines whether a speed change has been made when the encoder 80 detected passing of the slit 84 (the positive determination in S4), e.g., whether a Tempo Change event to change the playback tempo has been detected. Alternatively, the CPU 61 may determine whether an input operation for changing the tempo has been performed on the input operation unit. If the negative determination has been made in S6, in S7 the CPU 61 calculates a calibration value (delay value) from the constant rate calibration table in the calibration table 98 based on the playback tempo at the current time, and subsequently executes the process beginning from S9. However, if a positive determination has been made in S6, in S8 the CPU 61 calculates a calibration value from the calibration table 98 based on the pre-change playback tempo and post-change playback tempo, and subsequently executes the process beginning from S9. The CPU 61 temporarily stores the calibration value (delay value) calculated in S7 or S8 in a prescribed memory of the controller 60.

After the delay value calculated in S7 or S8 has elapsed, in S9 the CPU 61 executes an operation to release the corresponding stopper 22 from the anchoring state, where the corresponding stopper 22 is the stopper 22 corresponding to the vibration valve 18 that is to produce the tone of the note determined in S5. In other words, the CPU 61 begins supplying the electricity to the electromagnet 24 corresponding to the stopper 22.

In S10 the CPU 61 determines whether a speed change has been made by detecting whether a Tempo Change event has occurred, for example. Alternatively, the CPU 61 may determine whether an input operation for changing the tempo was inputted through the input operation unit. If a negative determination has been made in S10, the CPU 61 returns the process to S4 described above. However, if a positive determination has been made in S10, in S11 the CPU 61 changes the playback tempo based on the Tempo Change event detected in S10 or a tempo change command inputted in S10, and changes the rotational speed of the motor 32 corresponding to this change.

In S12 the CPU 61 determines whether the music being played has ended. If a negative determination has been made in S12, the CPU 61 returns the process to S4. However, if a positive determination has been made in S12, in S13 the CPU 61 stops driving the motor 32, ending the current routine.

In the control process described above, S1 is an example of the operation of the data-reading unit 101; S2, S11, and S13 is an example of the operation of the motor controller 102 (tempo modification control unit); S4 and S5 is an example of the operation of the timing determination unit 104; S7 and S8 is an example of the operation of the timing calibration unit 106; and S9 corresponds to the operation of the release controller 108.

While the disclosure has been described in detail with reference to specific embodiments thereof, it would be apparent to those skilled in the art that many modifications and variations may be made therein without departing from the spirit of the disclosure, the scope of which is defined by the attached claims.

For example, the timing calibration unit 106 in the preferred embodiment described above applies a calibration value (delay value) corresponding to a value related to the rotational speed of the motor 32 to the start timing set by the timing determination unit 104, the calibration value being a value greater than zero in the example of FIG. 13. However, the timing calibration unit 106 may also perform a calibration to advance the start timing set by the timing determination unit 104 using a negative calibration value. With this approach, the timing determination unit 104 preferably sets the start timing such that the star wheel 14 and the sun wheel 28 accurately meshingly engage with each other at a prescribed tempo (approximately 80 bpm, for example) in a constant-speed state without requiring calibration (i.e., with a calibration value of 0).

In S6 of the flowchart shown in FIG. 18, the CPU 61 determines whether a speed change was requested at the time the encoder 80 previously detected passing of a slit 84 and executes one of the processes in S7 or S8 depending on the result of this determination. However, the CPU 61 may instead be configured to determine whether a speed change was requested at the previous, previous time the encoder 80 detected the passing of a slit 84 and may execute one of the processes in S7 or S8 depending on the result of this determination. In other words, if a change in the playback tempo will affect the rotational speed while playing a note that is two notes earlier during the transitional phase in which the playback tempo is changed, the CPU 61 may calibrate the timing for this second note. That is, the vibration valve 18 may be plucked at multiple times during the transitional phase in which the tempo is changed due to the gradual decrease of the playback tempo. For example, if the actual tempo (rotational speed of the motor 32) at which the next, next note will be plucked has dropped to only 60 bpm during a transitional phase for decreasing the playback tempo from 120 to 40 bpm, the CPU 61 may apply, to this note (first note), the calibration amount used when the playback tempo is decreased from 120 to 60 bpm and apply, to the next note (second note), the calibration amount (given in units of millisecond in the calibration table 98) used when the playback tempo is decreased from 60 to 40 bpm.

The playback tempo read by the CPU 61 in S1 may be a tempo specified (inputted) by the user rather than the tempo specified in the music data (MIDI data). In the embodiment described above, the calibration value (time delay) is acquired based on the playback tempo and the like using predetermined correlations recorded in the calibration table 98, but the CPU 61 may acquire the calibration value based on the playback tempo and the like using a predetermined equation rather than a table.

The present disclosure is not limited to the structure described above with reference to FIGS. 1 through 18. For example, the number of claws 36 provided on each star wheel 14 is not limited to four and need not be arranged at 90-degree intervals around the periphery thereof. Further, the gear teeth 38 need not be provided at positions corresponding to the claws 36 and may be positioned at different phases around the periphery of the star wheel 14.

Further, the electromagnets 24 and the stoppers 22 belonging to the first group and the electromagnets 24 and the stoppers 22 belonging to the second group need not be disposed at 90-degree intervals in a circumferential direction around the axial center of the first shaft 12. For example, all electromagnets 24 may be juxtaposed along the same plane. Conversely, if five or more of the claws 36 were provided around the periphery of the star wheel 14, for example, pluralities of the electromagnets 24 and stoppers 22 could be arranged at positions corresponding to three or more phases spaced at prescribed phase differences in a circumferential direction around the axial center of the first shaft 12, depending on the number of claws 36 provided. Further, two or more of the stoppers 22 may be provided for each star wheel 14 as the mechanism for anchoring the star wheel 14.

The ECU 60 may also be connected to the Internet or another communication link and may be configured to download musical score data via the communication link and store this data in the musical score database 62.

In addition, the shape of the star wheel 14, structure of the stopper 22 (shape of the plate member 50), phase positions of the various components, and the like may be modified as needed to suit the design of the music box. For example, the gear teeth 38 need not be provided in pairs, but may be provided in groups of one or three or more, provided that the sun wheel 28 can drive the star wheel 14 a sufficient distance and time interval for allowing the claw 36 to pluck the corresponding vibration valve 18 of the vibration plate 16.

The stopper 22 may also be provided with a permanent magnet as the magnetic member. The permanent magnet reacts to the magnetic force of the electromagnet 24 when the electromagnet 24 is in an excitation state, and produces a force for rotating the stopper 22 in the direction away from the star wheel 14. The permanent magnet is preferably formed in the synthetic resin member 54, which is integrally provided with the plate member 50, through insert molding, and is preferably positioned to produce a repelling force (force of repulsion between like magnetic poles) with the electromagnet 24 when the electromagnet 24 is excited. The magnetic force of the electromagnet 24, i.e., the force of repulsion produced between the electromagnet 24 and the permanent magnet, moves the plate member 50 of the stopper 22 against the urging force of the torsion coil spring 56. Accordingly, the stopper 22 rotates about the third shaft 20 in a direction away from the star wheel 14 (the first rotating direction), thereby disengaging the plate member 50 from the claw 36 and placing the stopper 22 in the non-anchoring state.

Further, the motor controller 102 may control the rotational speed of the motor 32 through feedback control by detecting the rotational speed of the second shaft 26 supporting the sun wheels 28. Preferably a high-resolution encoder is provided on the second shaft 26 for detecting the rotations of the second shaft 26 or the sun wheels 28 at intervals finer than the slits 84 formed in the rotating disc 82. By detecting the rotation of the high-resolution encoder on the second shaft 26 using an optical sensor, such as the timing sensor 86, the motor controller 102 can control the rotational speed of the motor 32 through feedback.

What is claimed is:

1. A music box comprising:

a star wheel configured to rotate about a first shaft, the star wheel comprising a claw;

a stopper configured to halt a rotation of the star wheel;

a sun wheel fixed on a second shaft extending along the first shaft, the sun wheel being configured to engage the star wheel which has been released from a halt by the stopper;

a motor configured to rotate the first shaft and the second shaft;

a sensor configured to detect a rotation state of the sun wheel; and a controller configured to:

read a music data specifying a sound output timing and a tempo from a storage unit;

control the motor to rotate at a rotational speed based on the tempo of the music data;

determine a start timing at which the stopper starts to release a halt of the rotation of the star wheel based on the sound output timing and the rotation state of the sun wheel detected by the sensor;

calibrate the start timing to a calibrated start timing based on a value related to the rotational speed of the motor;

control the stopper to release the halt of the rotation of the star wheel at the calibrated start timing, and change the tempo from a first tempo to a second tempo slower than the first tempo and calibrate the start timing to the calibrated start timing later than the start timing when the tempo is changed from the first tempo to the second tempo.

2. The music box according to claim 1, wherein the controller configured to:

determine a rotational amount of the sun wheel based on the rotation state detected by the sensor; and determine the start timing based on the sound output timing and the rotational amount of the sun wheel.

3. The music box according to claim 1, further including an electromagnet configured to attract the stopper to distance the claw away from the star wheel; and wherein the controller is configured to energize the electromagnet at the calibrated start timing.

4. A music box comprising:

a star wheel configured to rotate about a first shaft, the star wheel comprising a claw;

a stopper configured to halt a rotation of the star wheel;

a sun wheel fixed on a second shaft extending along the first shaft, the sun wheel being configured to engage the star wheel which has been released from a halt by the stopper;

a motor configured to rotate the first shaft and the second shaft;

a sensor configured to detect a rotation state of the sun wheel; and a controller configured to:

read a music data specifying a sound output timing and a tempo from a storage unit.

control the motor to rotate at a rotational speed based on the tempo of the music data;

determine a start timing at which the stopper starts to release a halt of the rotation of the star wheel based on the sound output timing and the rotation state of the sun wheel detected by the sensor;

calibrate the start timing to a calibrated start timing based on a value related to the rotational speed of the motor;

control the stopper to release the halt of the rotation of the star wheel at the calibrated start timing, and change the tempo from a first tempo to a second tempo faster than the first tempo and calibrate the start timing to the calibrated start timing earlier than the start timing when the tempo is changed from the first tempo to the second tempo.

5. The music box according to claim 4, wherein the controller is configured to:

determine a rotational amount of the sun wheel based on the rotation state detected by the sensor; and determine the start timing based on the sound output timing and the rotational amount of the sun wheel.

6. The music box according to claim 4, further including an electromagnet configured to attract the stopper to distance the claw away from the star wheel and wherein the controller is configured to energize the electromagnet at the calibrated start timing.

7. A music box comprising:

a star wheel configured to rotate about a first shaft, the star wheel comprising a claw;

a stopper configured to halt a rotation of the star wheel;

a sun wheel fixed on a second shaft extending along the first shaft, the sun wheel being configured to engage the star wheel which has been released from a halt by the stopper;

a motor configured to rotate the first shaft and the second shaft;

a sensor configured to detect a rotation state of the sun wheel; and a controller configured to:

read a music data specifying a sound output timing and a tempo from a storage unit;

control the motor to rotate at a rotational speed based on the tempo of the music data;

determine a start timing at which the stopper starts to release a halt of the rotation of the star wheel based on the sound output timing and the rotation state of the sun wheel detected by the sensor;

calibrate the start timing to a calibrated start timing based on a value related to the rotational speed of the motor;

control the stopper to release the halt of the rotation of the star wheel at the calibrated start timing; and change the tempo from a first tempo to a second tempo different from the first tempo, store a calibration table having a calibration amount of the start timing depending on a relationship between the first tempo and the second tempo, and calibrate the start timing to the calibrated start timing based on the calibration amount of the calibration table when the tempo is changed from the first tempo to the second tempo.

8. The music box according to claim 7, wherein the controller is configured to:

determine a rotational amount of the sun wheel based on the rotation state detected by the sensor; and determine the start timing based on the sound output timing and the rotational amount of the sun wheel.

9. The music box according to claim 7, further including an electromagnet configured to attract the stopper to distance the claw away from the star wheel and wherein the controller is configured to energize the electromagnet at the calibrated start timing.

10. A music box comprising:

a star wheel configured to rotate about a first shaft, the star wheel comprising a claw;

a stopper configured to halt a rotation of the star wheel;

a sun wheel fixed on a second shaft extending along the first shaft, the sun wheel being configured to engage the star wheel which has been released from a halt by the stopper;

a motor configured to rotate the first shaft and the second shaft;

a sensor configured to detect a rotation state of the sun wheel; and a controller configured to:

read a music data specifying a sound output timing and a tempo from a storage unit;

control the motor to rotate at a rotational speed based on the tempo of the music data;

determine a start timing at which the stopper starts to release a halt of the rotation of the star wheel based on the sound output timing and the rotation state of the sun wheel detected by the sensor;

calibrate the start timing to a calibrated start timing based on a value related to the rotational speed of the motor;

control the stopper to release the halt of the rotation of the star wheel at the calibrated start timing; and store a constant rate calibration table having a calibration amount of the start timing on a tempo-by-tempo basis, the calibration amount being determined based on the tempo, and calibrate the start timing to the calibrated start timing based on the calibration amount relative to the tempo based on which the controller currently controls the motor to rotate at the rotational speed.

11. The music box according to claim 10, wherein the controller is configured to:

determine a rotational amount of the sun wheel based on the rotation state detected by the sensor; and determine the start timing based on the sound output timing and the rotational amount of the sun wheel.

12. The music box according to claim 10, further including an electromagnet configured to attract the stopper to distance the claw away from the star wheel and wherein the controller is configured to energize the electromagnet at the calibrated start timing.

13. A music box comprising:

a star wheel configured to rotate about a first shaft, the star wheel comprising a claw;

a stopper configured to halt a rotation of the star wheel;

a sun wheel fixed on a second shaft extending along the first shaft, the sun wheel being configured to engage the star wheel which has been released from a halt by the stopper;

a motor configured to rotate the first shaft and the second shaft;

a sensor configured to detect a rotation state of the sun wheel; and a controller configured to:

read a music data specifying a sound output tuning and a tempo from a storage unit;

control the motor to rotate at a rotational speed based on the tempo of the music data;

determine a start timing at which the stopper starts to release a halt of the rotation of the star wheel based on the sound output timing and the rotation state of the sun wheel detected by the sensor;

calibrate the start timing to a calibrated start timing based on a value related to the rotational speed of the motor;

control the stopper to release the halt of the rotation of the star wheel at the calibrated start timing;

change the tempo from a first tempo to a second tempo faster than the first tempo and calibrate the start timing to a first calibrated start timing when the tempo is changed from the first tempo to the second tempo; and change the tempo from a third tempo faster than the second tempo to the second tempo and calibrate the start timing to a second calibrated start timing later than the first calibrated start timing when the tempo is changed from the third tempo to the second tempo.

14. The music box according to claim 13, wherein the controller configured to:

determine a rotational amount of the sun wheel based on the rotation state detected by the sensor; and determine the start timing based on the sound output timing and the rotational amount of the sun wheel.

15. The music box according to claim 13, further including an electromagnet configured to attract the stopper to distance the claw away from the star wheel and wherein the controller is configured to energize the electromagnet at the calibrated start timing.

* * * * *